US005237308A

United States Patent [19]

Nakamura

[11] Patent Number: 5,237,308

[45] Date of Patent: Aug. 17, 1993

[54] SUPERVISORY SYSTEM USING VISIBLE RAY OR INFRARED RAY

[75] Inventor: Tetsuya Nakamura, Kawasaki, Japan

[73] Assignee: Fujitsu Limited, Japan

[21] Appl. No.: 837,495

[22] Filed: Feb. 18, 1992

[30] Foreign Application Priority Data

Feb. 18, 1991 [JP] Japan ..... 3-045774
Feb. 18, 1991 [JP] Japan ..... 3-045775

[51] Int. Cl.[5] ..... G08B 17/00

[52] U.S. Cl. ..... 340/588; 340/589; 340/630; 358/108; 358/113

[58] Field of Search ..... 340/588, 589, 555, 556, 340/521, 522, 630, 628, 506; 358/108, 110, 113

[56] References Cited

U.S. PATENT DOCUMENTS 4,999,614 3/1991 Ueda et al. ..... 358/113
5,121,201 6/1992 Seki ..... 358/108
5,133,605 7/1992 Nakamura ..... 358/113

FOREIGN PATENT DOCUMENTS 64-86687 3/1989 Japan .
1-268575 10/1989 Japan .
2-213610 8/1990 Japan .

*Primary Examiner*—Jin F. Ng
*Assistant Examiner*—Nina Tong
*Attorney, Agent, or Firm*—Welsh & Katz, Ltd.

[57] ABSTRACT

A smoke supervisory system comprising a visible image processor for calculating a differential image between a reference image and an input image and calculating parameters in the differential image; an address overlap detector for detecting whether the differential images overlap each other; an image element number change detector for detecting a change in the image element number of the differential image; and an address ratio change detector for calculating an address ratio of the differential image; or an equipment supervisory system comprising an image fetch device for fetching a reference image and an input image from an infrared image pick up device; a mask control device for masking the reference image and the input image; a differential operation device for calculating a differential image of an unmasked dividing image; a temperature distribution difference detector for detecting a maximum temperature and a mean temperature of a temperature distribution from the differential image and calculating a temperature distribution difference; and when the calculated temperature distribution difference is more than a predetermined level, detecting an abnormal sign. By using this invention, in any environmental conditions, early detection of smoke generation is automatically executed and early and accurate detection of an abnormal temperature can be realized.

6 Claims, 22 Drawing Sheets

| Fig. 10A |
| --- |
| Fig. 10B |

ENVIRONMENT TEMP. CHANGE

CHANGE BY SUNSHINE etc.

ABNORMALITY OF SUPERVISORY OBJECT

SUPERVISORY SYSTEM USING VISIBLE RAY OR INFRARED RAY

BACKGROUND OF THE INVENTION

1. Field of the Invention

A first aspect of the present invention relates to a smoke supervisory system, and more particularly relates to a smoke supervisory system constantly supervising an installation, equipment, or the like, existing on a large scale e.g., an outdoor space, which immediately detects the generation of smoke as a result of a fire, and activates an alarm or the like.

A second aspect of the present invention relates to an equipment supervisory system, and more particularly to an equipment supervisory system constantly supervising the temperature of equipment installed in an arbitrary space and outputting alarm information on the detection of an abnormal temperature.

2. Description of the Related Art

Generally when a fire occurs in large scale equipment, apparatuses, or the like installed in a large space e.g., indoor or outdoor, and if fire fighting is carried out, the possibility of loss of life and valuable resources or equipment is high. Therefore, it is necessary to accurately detect and measure the generation of smoke by supervising the same in order to prevent the fire.

The generation of smoke is as follows. First, when a small temperature change occurs locally, an abnormal temperature domain spreads rapidly and when the stored heat in the equipment attains an ignition point, a fire or explosion occurs.

At that time, sudden ignition from the normal state does not occur, and as a middle step, preliminary smoke generation is started. Accordingly, the smoke supervisory system is necessary. As a supervisory system for detecting smoke generation, a sensor using system and a visible ray camera system has been proposed.

The sensor system widely uses a smoke sensor e.g., semiconductor gas sensor utilizing an oxide semiconductor to detect smoke generation directly from the equipment or apparatus installed in an arbitrary space indoors. In the smoke supervisory system utilizing a smoke sensor, the sensor is attached on the ceiling indoors, responds and detects the smoke or gas generated from various equipment or apparatuses installed locally by an oxide reaction in the sensor, transmits the detected data to separate installed supervisory equipment and monitor, and when the density of the smoke or gas attains a certain value, an alarm is activated.

In a visible camera system, a common television camera is used that displays an arbitrary space indoors as a visible image. In this system, an operator constantly monitors the image, detects an abnormal image due to smoke generating from the equipment installed in the said space, and outputs an abnormal display or alarm by manual operation.

In the conventional system using the smoke sensor, since it is a spot sensor, and the density of the smoke or gas generated from the equipment is detected locally, it is unsuitable for a plurality of equipment or for the supervision of a large space outdoors. Further when in a large indoor space, it takes a long time for the spot sensor to detect gas or smoke emanation. As a result, only in small spaces and under limited conditions, can the rapid detection of smoke or gas generation be carried out. In addition since the operator directly monitors the area, and the detection of smoke is not automatic, a misoperation due to human error can occur.

While recently, in electric power plants having large transformers or the like and in petrochemical plants, an equipment supervisory system that can monitor the temperature conditions or provide inspection time information constantly and accurately is desired to prevent a fire or explosion, and to ensure the efficient maintenance and conservation of power.

In a conventional equipment supervisory system, in order to detect an abnormal temperature generated in equipment installed in a space outdoors or indoors, thermocouples, thermistors, or the like, which are contact type temperature sensors, are utilized.

In the equipment supervisory system utilizing temperature sensors, the sensors are fixed on the equipment, the detected temperature data is transmitted to the supervisory apparatus and monitored. When an abnormally high temperature is detected, an abnormal display or alarm is output or activated.

Since contact type sensors are point sensor types, however, many sensors are necessary when a plurality of equipment exist or a plurality of portions require monitoring. Further when an abnormally high temperature is detected, it is occasionally only just before a fire or explosion, and consequently is too late. Therefore with this type of sensor, the early detection of an abnormal temperature is difficult.

On the other hand, instead of using temperature sensors as an equipment supervisory system detecting the early occurrence of an abnormal temperature of large scale equipment covering a large area, a method utilizing a differential temperature image is proposed.

In this method, the temperature of the said equipment is monitored by an infrared ray camera, and two different infrared images, separate in time, are stored as an input image and a reference image, and a simple differential image between the two images is obtained. The differential image is displayed as a histogram to the temperature and image element number by graphical representation; they are compared with predetermined detecting temperature data and a detecting image element number, and when they are in excess, an abnormal temperature is detected early and an alarm or display of the abnormal temperature sign is output.

In the equipment supervisory system utilizing the differential infrared image, in contrast to the point temperature sensor, a multipoint inspection wherein multiple temperature data can be obtained simultaneously, and, if the object equipment exist outdoors, abnormal temperature indication caused by the effect of sunshine, wind, or change of environmental temperature is not detected.

The conventional arts regarding this invention, are disclosed in Japanese unexamined patent publications (Kokai) 1-288086, 2-109196, and 3-182185.

SUMMARY OF THE INVENTION

The object of a first aspect of the invention is to realize a smoke supervisory system wherein, under any environmental conditions, early detection of smoke generation and the necessary activation of an alarm are automatically executed.

The object of a second aspect of the invention is to realize an equipment supervisory system wherein precise early detection of an abnormal temperature can be detected without being influenced by the effects of environmental changes, sunshine, wind, or the like.

In a first aspect of the invention, there is provided a smoke supervisory system comprising a visible ray image pick up means for picking up an image at an arbitrary location; a visible image processing means for fetching the picked up images from the visible ray image pick up means at a certain time interval; the preceding fetching image being a reference image and the next fetching image being an input image to be supervised, for calculating a differential image from the input image and the reference image, and for calculating a two dimensional address and an image element number on an image frame of the differential image; an image change detection means for updating the reference image and the input image in the visible image processing means when the two dimensional address and image element number of the differential image is less than a predetermined level, and for fixing the reference image and updating the input image when the two dimensional address and image element number of the differential image is more than a predetermined level; an address overlap detection means for detecting whether the two dimensional addresses overlap on the two dimensional axes; an image element number change detection means for detecting a change in the image element number; an address ratio change detection means for detecting the change of the address ratio by calculating the address ratio on the two dimensional axes from the two dimensional address; and a first degree smoke detection means for outputting an initial first degree smoke detection signal when each of the two dimensional addresses overlap by the address overlap detection means; each change in the image element number by the image element number change detection means, and each change of the address ratio by the address ratio change detection means is detected simultaneously.

In a second aspect of the invention, there is provided an equipment supervisory system comprising an infrared ray image pick up means for picking up an infrared image from a supervisory object at an arbitrary location; an image fetch means for fetching the picked up image from the infrared ray image pick up means at a certain time interval, and storing the preceding fetched image as a reference image and the next fetched image as an input image; a mask control means for dividing the fetched and stored reference image and the input image into a plurality of areas, for masking all other areas except one divided image, and for moving an unmasked divided image at a certain time interval; a differential operation means for calculating the differential image between the unmasked divided images in the divided input image and reference image; a temperature distribution difference detection means for detecting a maximum temperature $T_{MAX}$ and a mean temperature $T_{AV}$ in a temperature distribution on an object from the differential image and for calculating a difference $\Delta T$ of the temperature distribution; and an abnormal sign detection means for calculating a predetermined number of mean values $\Delta T_{AV}$ continuously in a predetermined time to confirm a continuous temperature increase characteristic of the temperature distribution difference $\Delta T$, for detecting an abnormal sign when the calculated temperature distribution difference $\Delta T$ is more than a predetermined level, for updating the input image to the reference image, and for repeating the fetch of the next image as an input image when the abnormal sign is not detected or before the mean value $\Delta T_{AV}$ is calculated.

Other features and advantages of the invention will be apparent from the following description with reference to the accompanying drawings.

Figure 16:
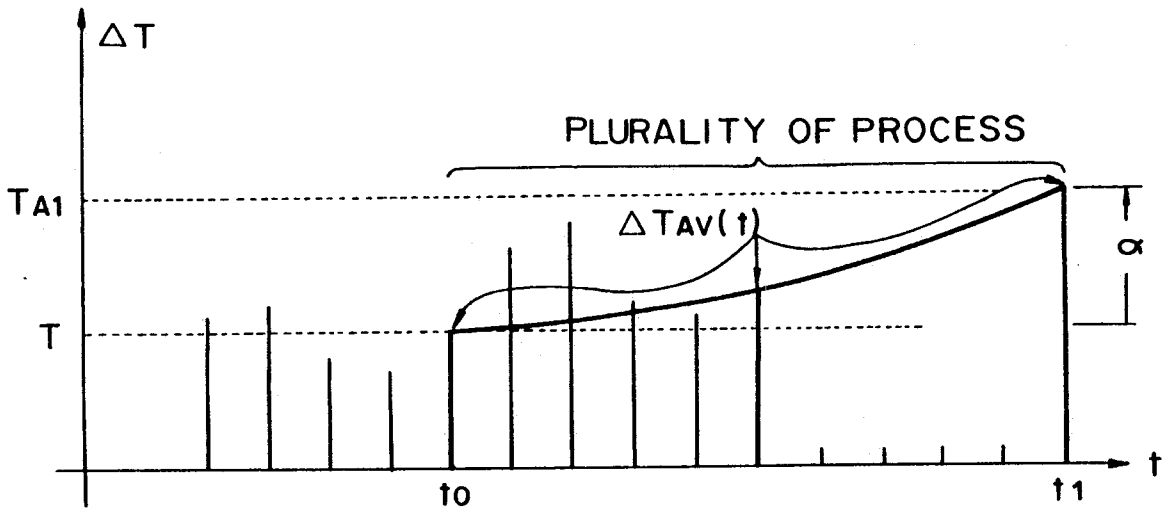
Figure 17:
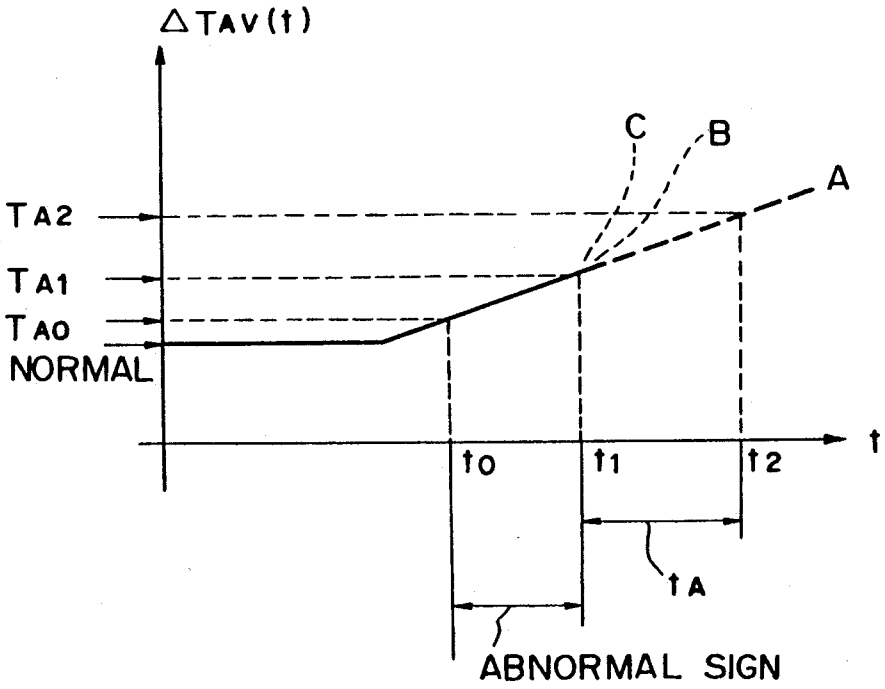
Figure 18:
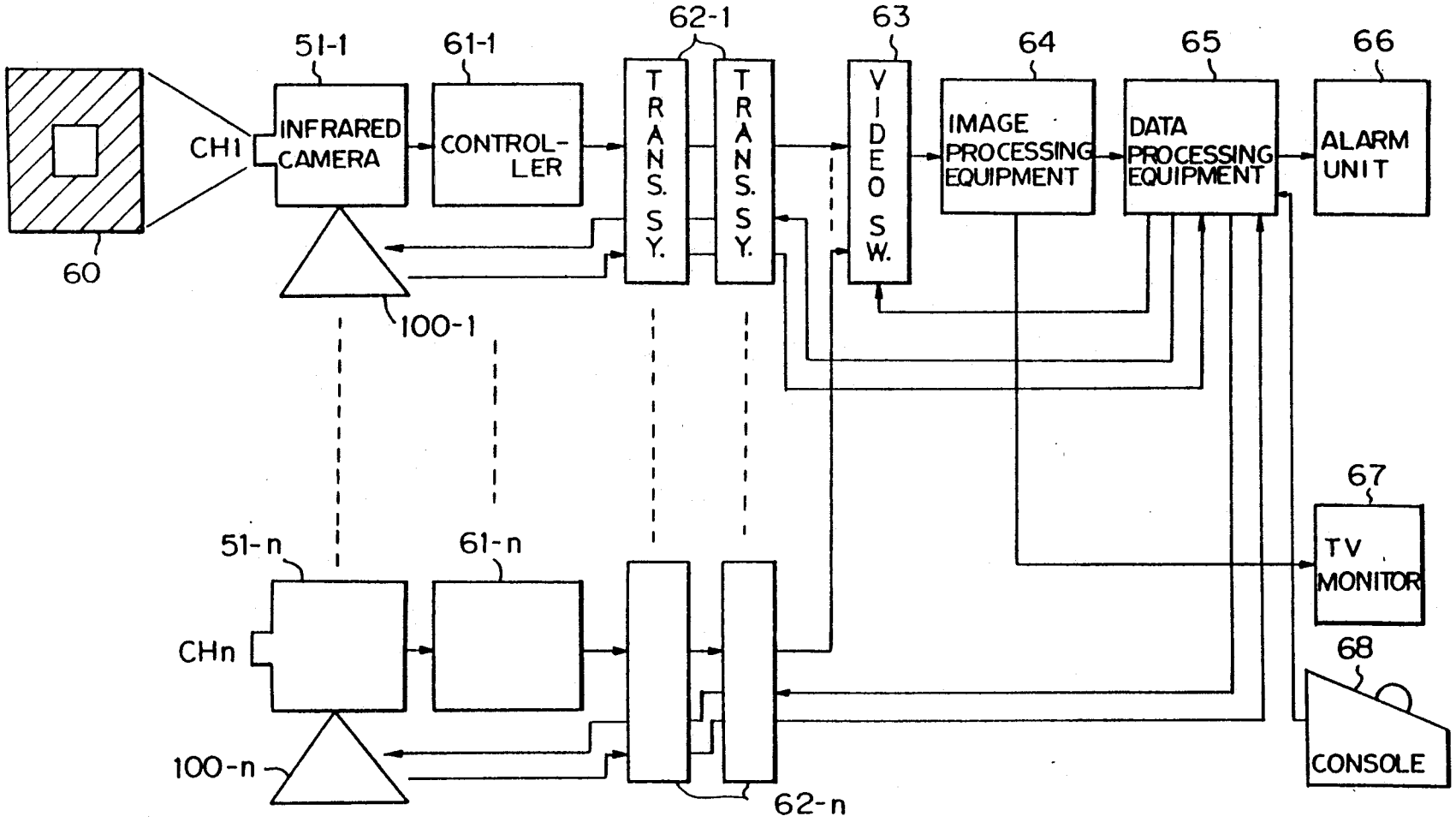
Figure 19:
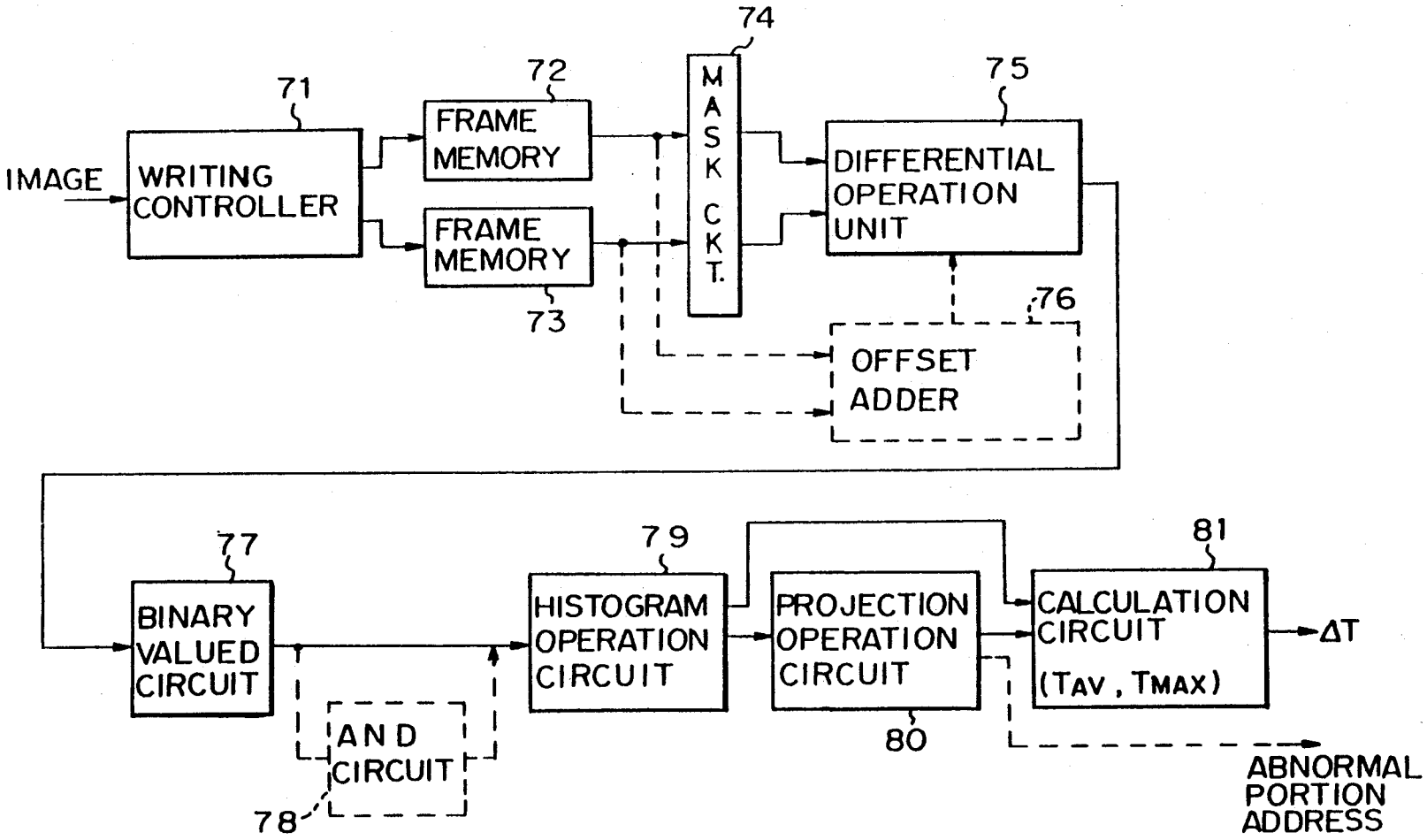
Figure 20A:
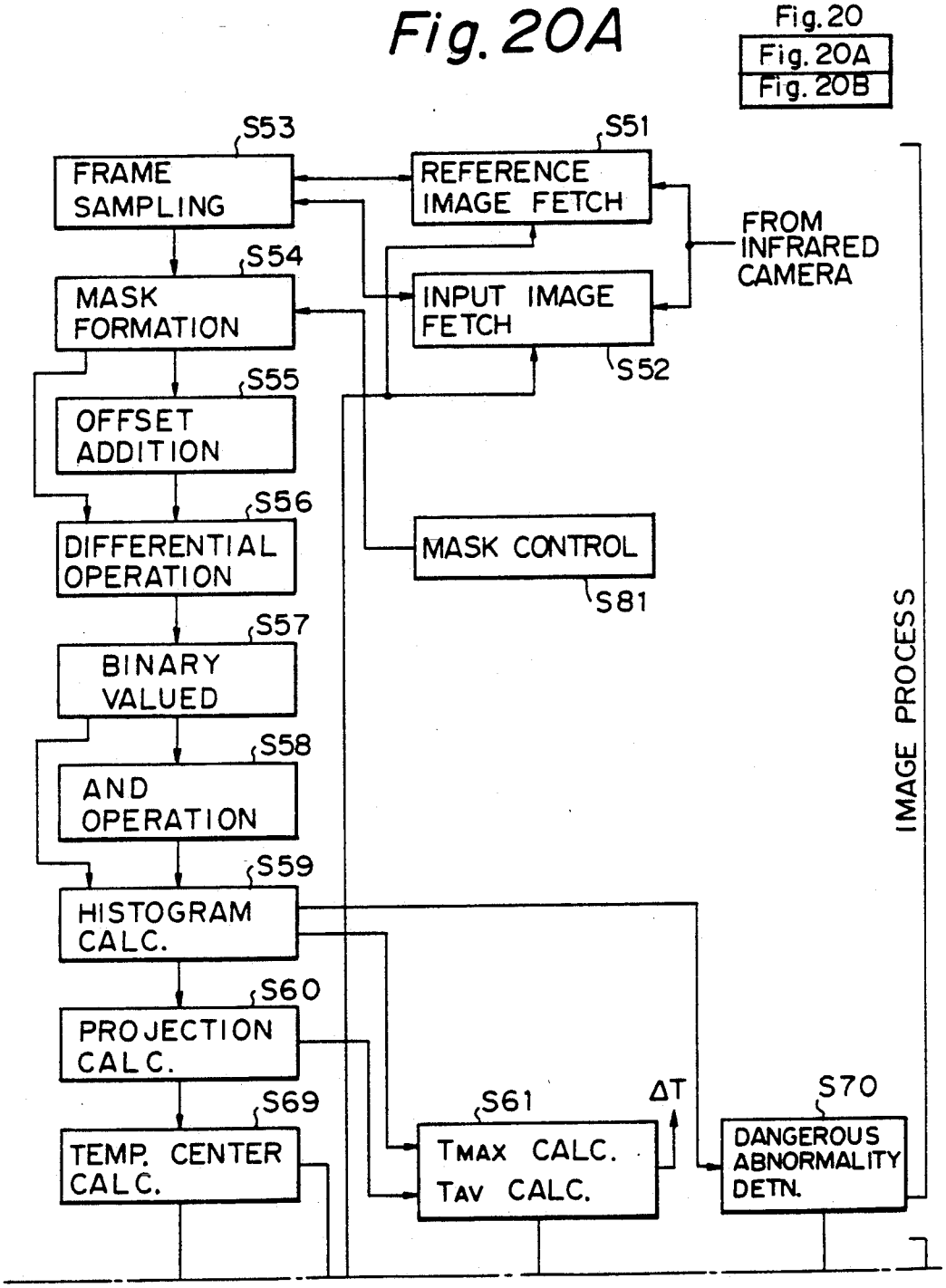
Figures 20, 20A, 20B:
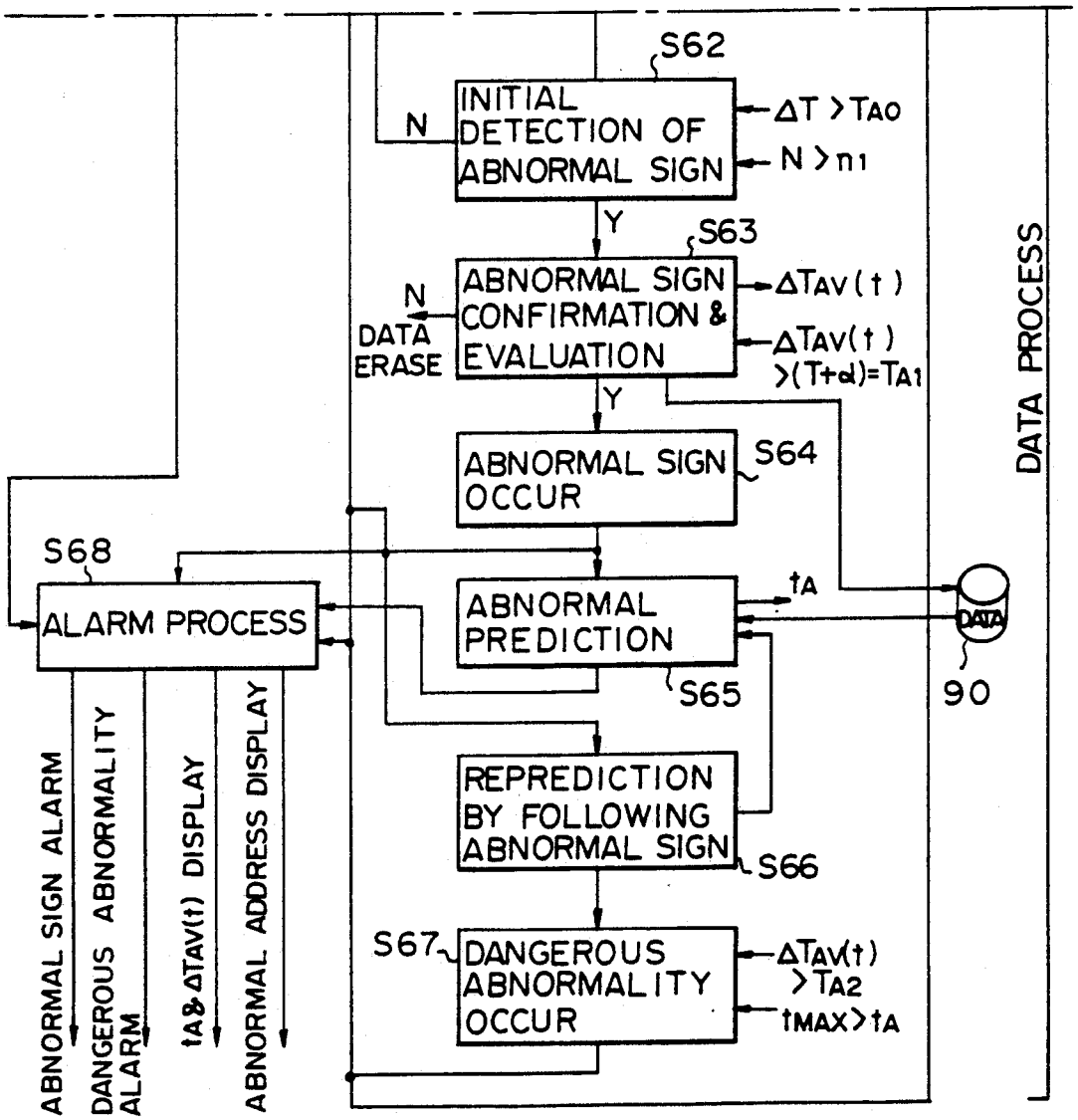

FIGS., 15A, 15B, and 15C are diagrams explaining mask processing;

FIG. 16 is a graphical representation explaining determination of an abnormal sign;

FIG. 17 is a graphical representation explaining the prediction of an abnormality;

FIG. 18 is a block diagram of an equipment supervisory system according to an embodiment of the second aspect of the invention;

FIG. 19 is a block diagram of image processing equipment of FIG. 18; and FIG. 20, comprising FIGS. 20A and 20B, is a process flowchart of the system of FIG. 18.

DESCRIPTION OF THE PREFERRED EMBODIMENTS

Smoke Supervisory System

A smoke supervisory system according to an embodiment of a first aspect of the invention is explained below.

First, prior to the explanations, the related arts are explained with reference to drawings.

Figure 2:
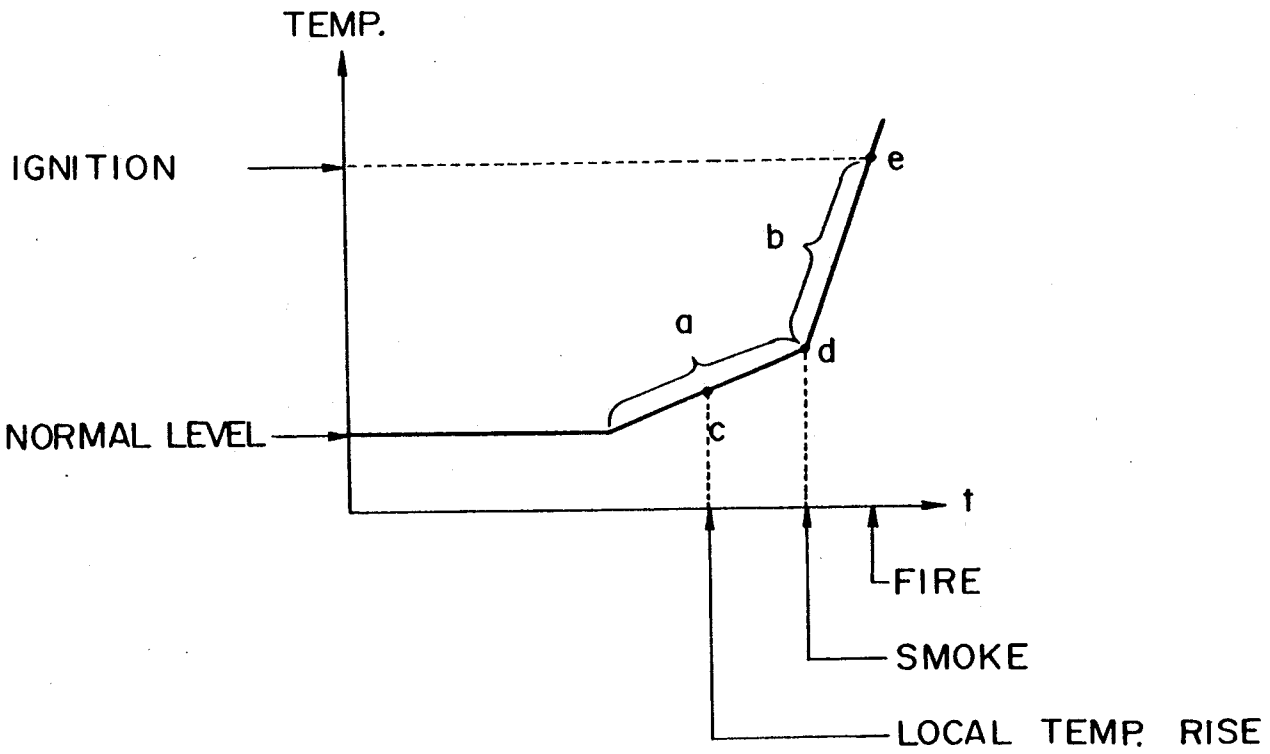
FIG. 2 is a graphical representation explaining a relationship between general smoke generation and a local temperature.

In FIG. 2, a process of smoke generation is explained. For a start, when a fine temperature abnormal portion is generated locally (c point in FIG. 2), the abnormal temperature area quickly spreads, an abnormal sign state illustrated by a line (a) appears, then through a curve (b) the heat stored in the equipment attains an ignition point, as a result, a fire or an explosion occurs (e point).

At that time, the fire does not generate abruptly from a normal state. As a middle stage, preliminary physical phenomenon, wherein if the local abnormal temperature rises to a certain level, smoke generates gradually (d point) as an indication of fire and flames soon appear from the smoke.

Generally, the smoke generation pattern proceeds gradually, changing scale or shape with time. For the smoke generation pattern, the supervisory time is divided into several portions. In the respective divided times, images of the smoke are detected and if changes in the smoke are detected among these images, early smoke detection can be carried out even from equipment installed in a large outdoor area.

These states are explained in detail with reference to the upper portion of FIG. 3. The smoke generation pattern starts at a time ($t_0$) when the state is normal (reference image), no smoke generation exists, and only the background is shown, then proceeds to time ($t_1$) when smoke generation is in an initial state, namely, only the smoke source as a fire source, exists, and then proceeds to the time ($t_2$) changing slowly in size and shape, and finally attains a final state time ($t_n$)

Figure 4:
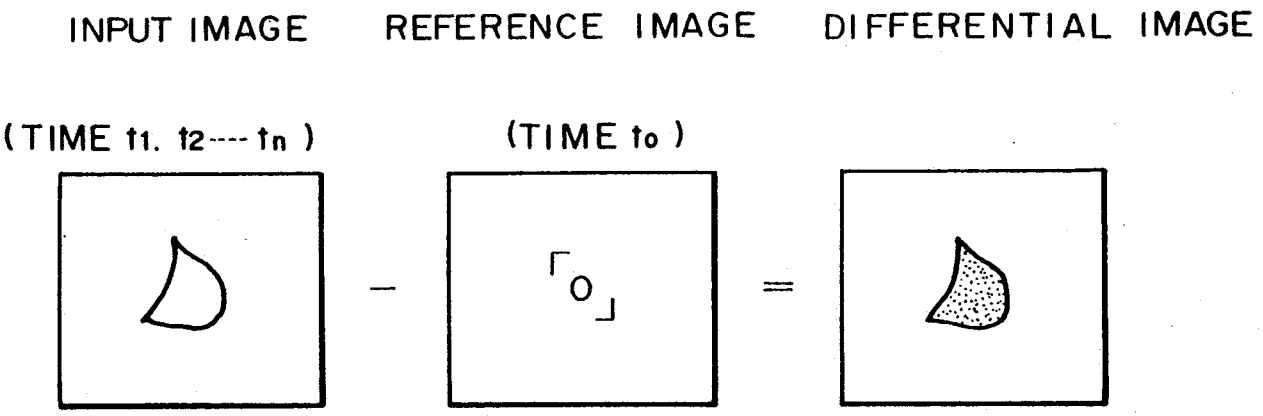
FIG. 4 is a diagram explaining the formation of a differential image from an input image and a reference image.

Further, shown in FIG. 4, the reference image at time ($t_0$) is subtracted from the respective input images at times ($t_1$, $t_2$, . . ., $t_n$) by the differential operations, then the backgrounds cancel each other. Only the changed portions remain as an image change and differential images are obtained. Namely, the smoke generation pattern (size and shape) is obtained corresponding to the time passing. In addition, the change of the visible image is usually generated naturally as an image being light and black caused by the movement of an article in the image.

In the differential image caused by an image change, a movement, e.g., a persons, a small animal, a vehicle, an inanimate object disturbed by the wind, sunshine, a reflecting ray or the like in the general environment other than the smoke can be detected, and therefore, in smoke detection via image change, the above factors must be excluded as much as possible.

In the differential image of the moving article, the address (coordinates) of the change portion of the image always exists and moves, and the size and shape thereof are substantially constant.

Regarding the effect by sunshine or a reflecting ray on the differential image, since generally the reflection rate or reflection surface size is constant over a short time, the movement of the address does not exist, and image size or shape change is also constant.

Figure 3:
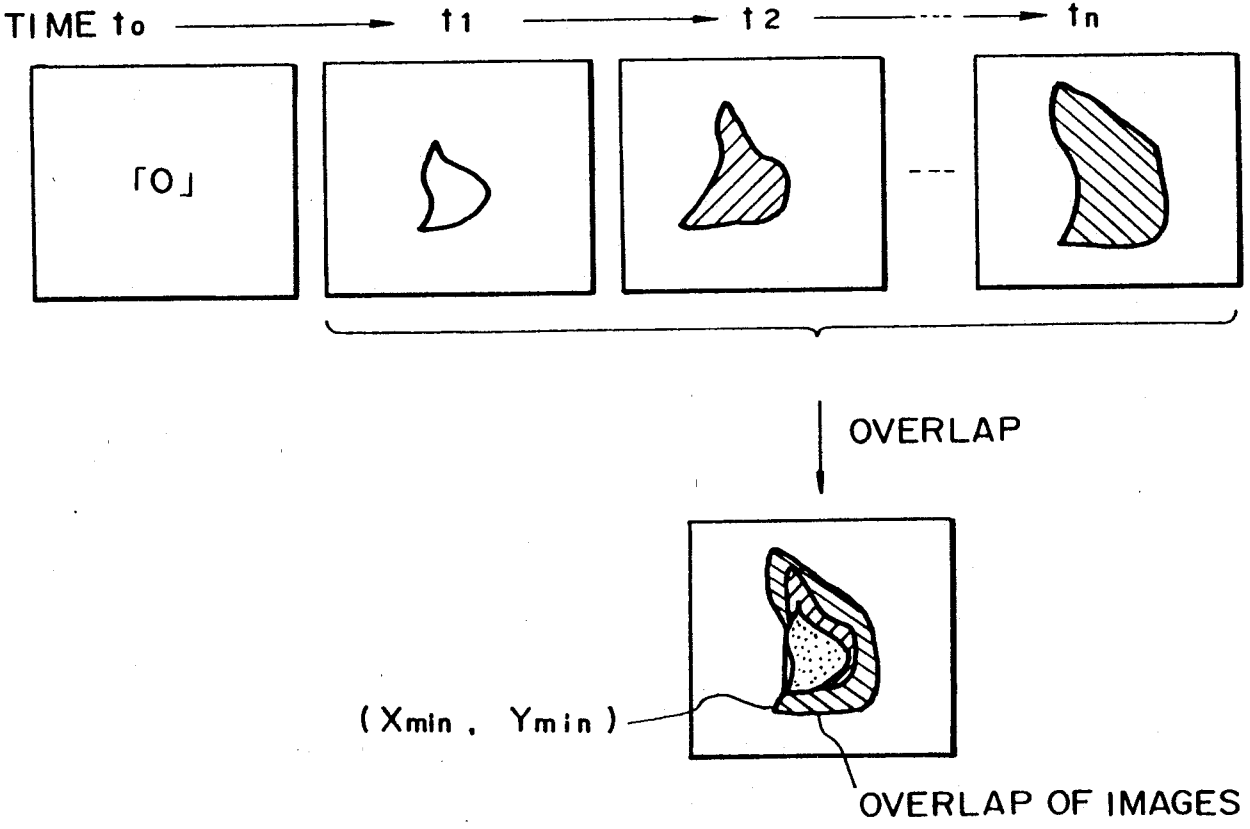
FIG. 3 is a diagram explaining a smoke generation pattern when time passes.

On the other hand when smoke generation occurs, since the coordinates of the smoke source shown at times ($t_1$) to ($t_n$) in the upper portion of FIG. 3 scarcely change over a short time and are constant, accordingly the addresses are always included at any time. If the visible images of the smoke conditions at each time overlap each other, as shown in the lower portion of FIG. 3, the common portion shown by a dot of each image corresponds to a smoke source. Namely, during smoke generation, movement of the address does not exist, and in the moving article, the overlapping of addresses does not exist.

Accordingly, in order to distinguish smoke detection from the above-mentioned external change factors, if the addresses overlap, image size changes and shape changes occur, the smoke is easily distinguished from the detection of other articles.

As described above, in order to detect early smoke generation from the equipment accurately, it is understood that smoke generation should be detected using the image processing system (differential image) by utilizing the visible image, which is more advantageous than the smoke sensor system (spot sensor system) used in the conventional smoke supervisory system. At that time, to ensure smoke detection, the confirmation of the feature of the address or size of the image is necessary.

Figure 1:
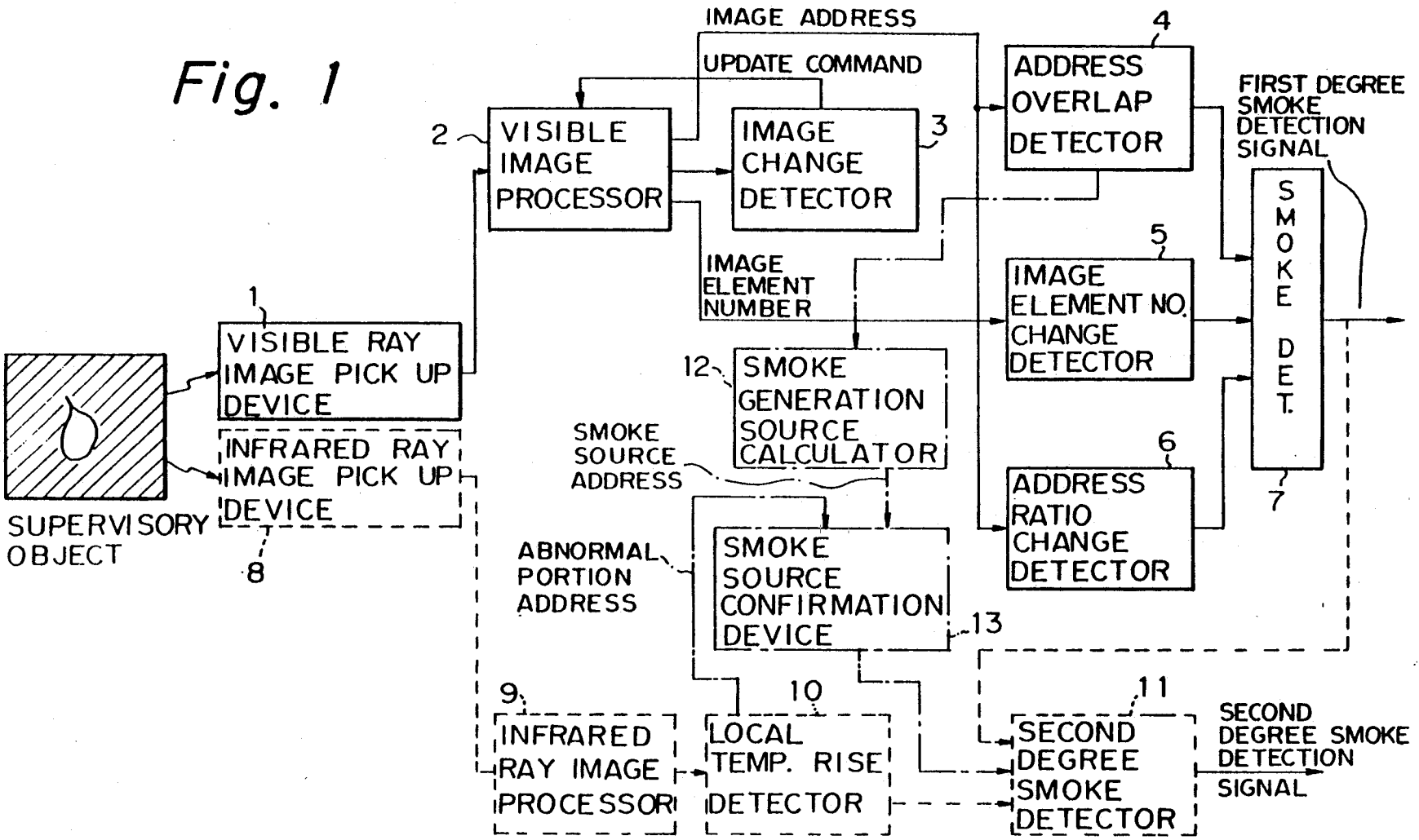
FIG. 1 is a block diagram explaining a summary of a first aspect of the invention.

Next, the summary of the smoke supervisory system according to a first aspect of the invention shown in FIG. 1 is explained. First, a visible ray image pick up device 1 constantly picks up a visible image to obtain an external change at an arbitrary location in which object equipment is installed.

At this time, a visible image processor 2 fetches (sample) the picked up image from the visible ray image pick up device 1 over a certain time interval, and the preceding fetched image is a reference image and the next fetched image is an input image to be supervised. A differential image from the fetched input image and the reference image is calculated and transmitted to an image change detector 3. Then, from the differential image, an image element number corresponding to an address value on coordinates projected on the X axis and Y axis corresponding to the address coordinates on the image frame to distinguish smoke generation from other moving articles, and the area of the differential image are calculated, respectively.

Next, in the image change detector 3, the detection of the smoke is usually effected from an image change greater than a certain level of the visible image to exclude error factors when image processing. Namely, the parameters, density, size, or the like of the differential image obtained from the visible image processor 2 are also detected when they are greater than a predetermined level, if less than a predetermined level (noise), the fetches of the reference image and the input image are repeated by operating the visible image processor 2. If the level is greater than the predetermined level, the reference image is left as it is and only the input image is fetched and updated at a plurality of times by operating the visible image processor 2. Then, the differential image between the input image and the reference image, addresses, and image element number of the differential image are calculated in the visible image processor 2.

Accordingly, in an address overlap detector 4, the addresses detected at a plurality of times on the X and Y axes by the visible image processor 2 are detected whether they overlap each other or not.

Figures 5A, 5B, 5C:
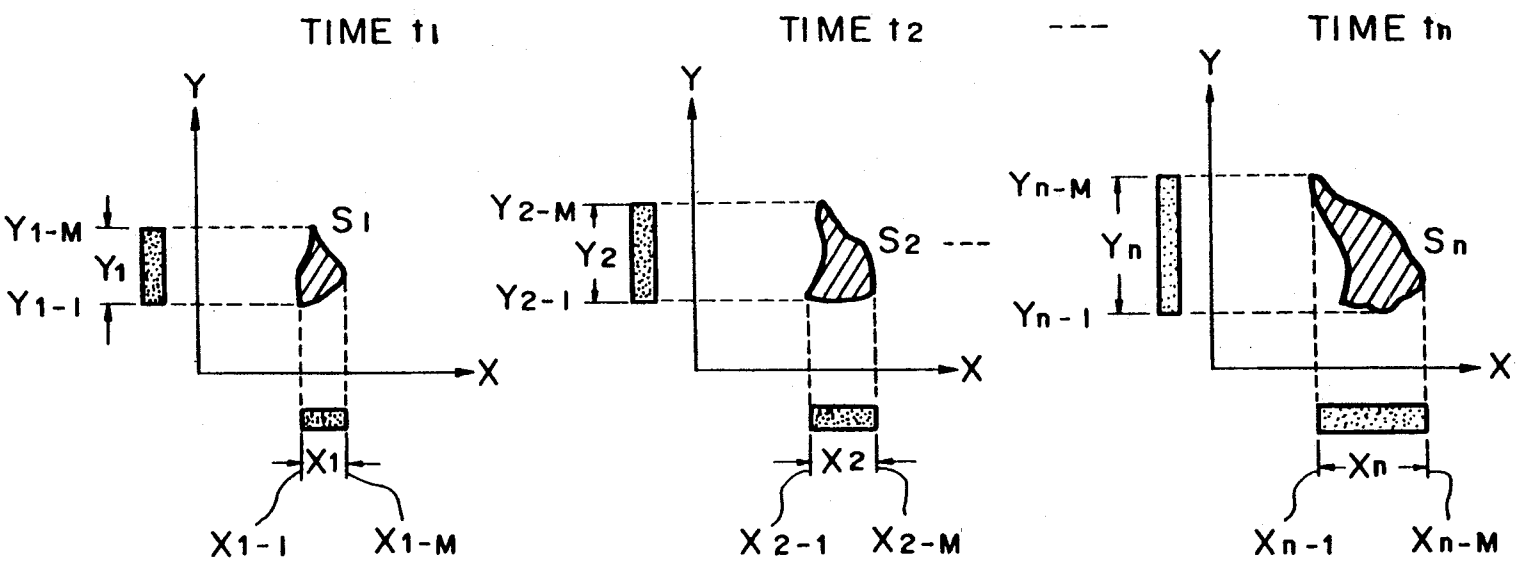
FIGS. 5A, 5B, and 5C are diagrams showing a smoke generation address.
Figure 6:
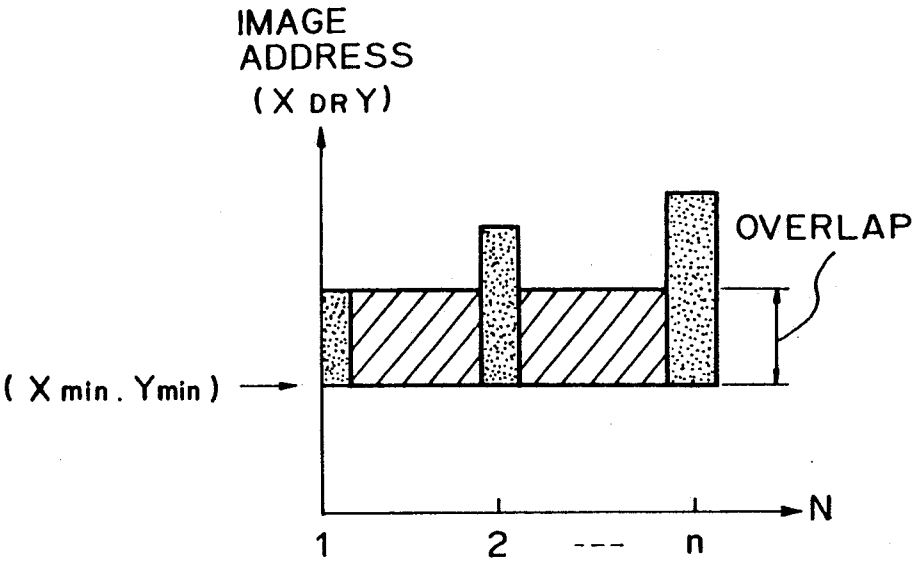
FIG. 6 is a graphical representation explaining an address overlap.

FIGS. 5A, 5B, and 5C show a plurality of (n times) projected states wherein the differential images at times ($t_1$) to ($t_n$) are projected on the X axis and Y axis. In the figure, $X_1$ to $X_n$ and $Y_1$ to $Y_n$ have M number of small divided addresses, respectively, each of the addresses designate the smoke generation address projected on the X and Y axes, and $S_1$ to $S_n$ designate the image element number corresponding to image size (area). The address ($X_n$, $Y_n$) at time ($t_n$) always includes the address ($X_1$, $Y_1$) at time ($t_1$). The overlapping of the addresses, as shown in FIG. 6, is shown by an oblique line. In this place, an abscissa illustrates processing times and an ordinate illustrates the address (X or Y).

Figure 7A:
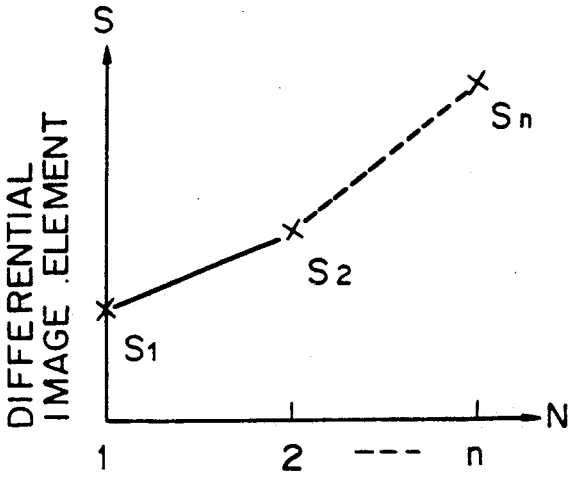
FIGS. 7A and 7B are graphical representations showing an image element number and an address ratio, respectively.

In an image element number change detector 5, a plurality of image element numbers detected by the visible image processor 2 are detected whether or not they are changed as shown in FIG. 7A, namely, rising curve designated by $S_1, S_2, \ldots, S_n$.

Figure 7B:
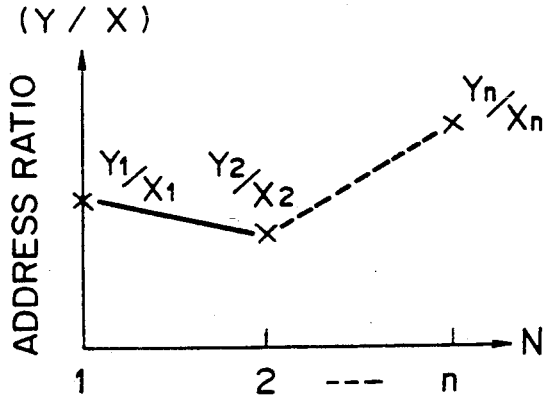

Further, in an address ratio change detector 6, address ratios $Y_1/X_1, Y_2/X_2, \ldots, Y_n/X_n$ are calculated from the plurality of address values detected by the visible image processor 2. Then, between each of the differential images, the address ratios are detected whether or not they change as shown in FIG. 7B, e.g., an increasing and decreasing curve.

As a result, finally in a first degree smoke detector 7, when all of the conditions below are detected simultaneously, i.e., the address overlap between the differential images detected by the address overlap detector 4, the change in the image element numbers between the differential images detected by the image element number change detector 5, and the change of the address ratio between the differential images detected by the address ratio change detector 6, the first degree smoke detection signal, which is the initial smoke generation information, is output.

Also, in the smoke generation, as shown in FIG. 2, an abnormal local temperature increase always occurs. Therefore, in this invention, as shown in FIG. 1 by the broken lines, an infrared ray pick up device 8, an infrared image processor 9, a local temperature rise detector 10, and a second degree smoke detector 11 are provided. The infrared ray pick up device 8 picks up a local temperature change or flame at an arbitrary location of the installed equipment as an infrared image, and the infrared image processor 9 calculates a differential image by a simple subtracting operation between the input image and the reference image, both of which contain temperature information at different pick up times obtained from the infrared ray pick up device 8.

Then, only when the local temperature rise detector 10 detects a local temperature rise in the space from the differential image, and simultaneously the first degree smoke detection signal output from a first degree smoke detector 7 is detected in a second degree smoke detector 11, the second degree smoke detection signal is output. Thus, the detection can be carried out with greater precision.

Further, in this aspect of the invention, the address by which the local temperature rise detector 10 specifies the abnormal portion when local temperature abnormality occurs, can be calculated. Further, a smoke generation source calculator 12 and a smoke source confirmation device 13 shown in FIG. 1 by the broken line are provided, and by the address overlap detection result in the smoke generation source calculator 12 from the address overlap detector 4, the smoke generation source address is specified and calculated. Then, the smoke generation source address calculated by the smoke generation source calculator 12 and the address of the temperature abnormal portion calculated by the local temperature rise detector 10 are input to the smoke source confirmation device 13. These are compared, and only when they concur, is the result output to the second degree smoke detector 11.

Accordingly, in the second degree smoke detector 11, only when the first degree smoke detection signal output from the first degree smoke detector 7, the temperature abnormal rise detection signal from the local temperature rise detector 10, and the coincidence signal from the smoke source confirmation device 13 are simultaneously detected, the second degree smoke detection signal is output. Thus, precise detection of smoke generation can be executed.

Figure 8:
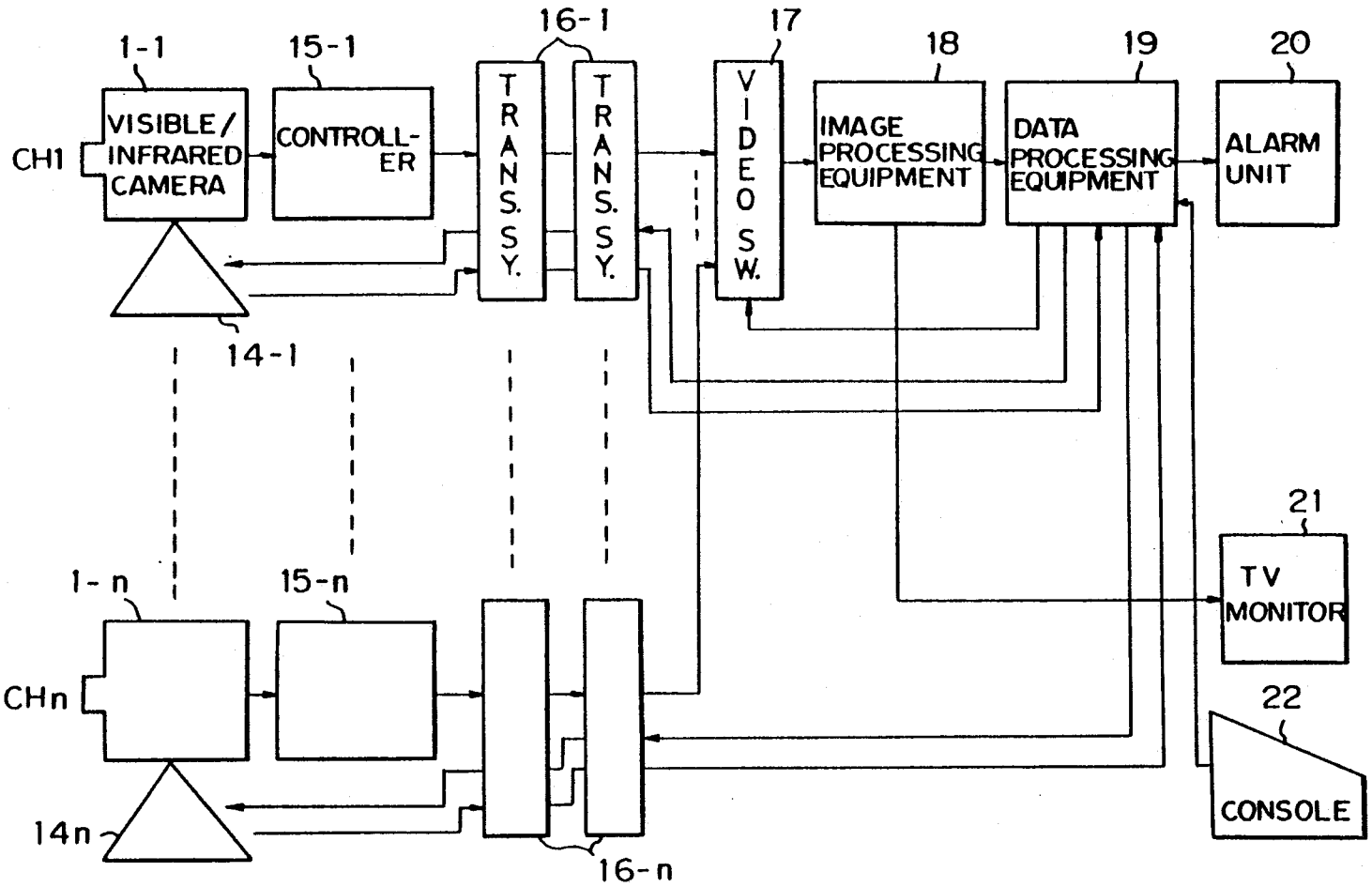
FIG. 8 is a block diagram of a smoke supervisory system according to an embodiment of the first aspect of the invention.

Below, a smoke supervisory system according to an embodiment of the first aspect of the invention is explained. FIG. 8 shows the block diagram of the smoke supervisory system. 1-1 to 1-n are visible/infrared ray cameras for n channels corresponding to the visible ray image pick up device 1 and the infrared ray image pick up device 8 in FIG. 1. In this embodiment, a twin lens type composite camera commonly used for visible ray-/infrared ray, and having the same optical axis and the same view range, is used. These visible/infrared cameras are provided with n set, allowing for wide range supervision. Also to supervise a wider range or obtain greater precision detection, CHl to CHn cameras, which are different in pick up position or pick up angle, are provided, and these are selected by the camera support head console 22. Hereinafter, these visible/infrared cameras 1-1 to 1-n are sometimes called reference numeral "1" as a whole.

14-1 to 14-n are rotary support heads that receive control signals from the console 22 and support and rotate the visible/infrared cameras 1-1 to 1-n, 15-1 to 15-n are controllers for controlling the image pick up state of the visible/infrared camera 1-1 to 1-n, 16-1 to 16-n are transmission systems for transmitting the respective pick up images from the controllers 15-1 to 15-n, 17 is a video switcher for switching the picked up images from the transmission systems 16-1 to 16-n, 18 is image processing equipment including the visible image processor 2 and the infrared image processor 9 in FIG. 1 for executing the visible and infrared image processings separately, 19 is data processing equipment including the image change detector 3, the address overlap detector 4, the image element number change detector 5, the address ratio change detector 6, the first degree smoke detector 7, the local temperature rise detector 10, the second degree smoke detector 11, the smoke generation source calculator 12, and the smoke source confirmation device 13 for controlling the video switcher 17 and the rotary support heads 14-1 to 14-n through the transmission systems 16-1 to 16-n, 20 is an alarm unit for generating an alarm or the like for alerting of smoke generation or fire in response to a result of the data processing equipment 19, 21 is a television monitor for displaying the differential image or the like output in response to a result of a differential operation in the image processing equipment 18, and 22 is a console connected to the data processing equipment 19, for controlling the respective rotary support head 14-1 to 14-n. In addition, a control line from the console 22 is connected to the rotary support heads 14-1 to 14-n through the data processing equipment 19 and the transmission systems 16-1 to 16-n. In the figure, the same reference mark denotes the identical element or a corresponding portion.

In this embodiment, first, the visible/infrared ray cameras 1-1 to 1-n pick up the arbitrary space indoors or outdoors as a visible/infrared image, the image is transmitted to the transmission systems 16-1 to 16-n through the exclusive controllers 15-1 to 15-n, and the video switcher 17 switches to select the picked up image data from the transmission systems 16-1 to 16-n in response to the command from the data processing equipment 19 and sends the same to the image processing equipment 18.

The image processing equipment 18 calculates the differential image by the differential operation between the input image and the reference image, which are different in pick up time in the received pick up images (both visible and infrared images). Further, it displays the temperature or density difference and image element number of the differential image on the histogram, and particularly in the case of the visible image, the address of the portions having density differences and the differential image element number are calculted.

Further, in the case of the visible image, the data processing equipment 19 detects smoke after confirming the address overlap of the differential images and the change in the image element number to distinguish smoke detection from the external changing factors by the calculated address and the image element number of the differential image.

In the case of the infrared image, the parameter is compared with the setting ranges in the detected temperature data using the result on the histogram and the detected image element number, when the parameter is more than the setting range, the local temperature rise and any dangerous abnormality is detected. Simultaneously, the detection is operated by AND operation by the above smoke detection in the case of the visible image, thus, smoke detection is made more certain. In addition, at this time, also, the addresses of the abnormal temperature portion are calculated.

The alarm unit 20 generates an alarm from the detection signals in accordance with the result of the data processing, and the television monitor 21 monitors the picked up image or the differential image processed by the image processing equipment 18.

Figure 9:
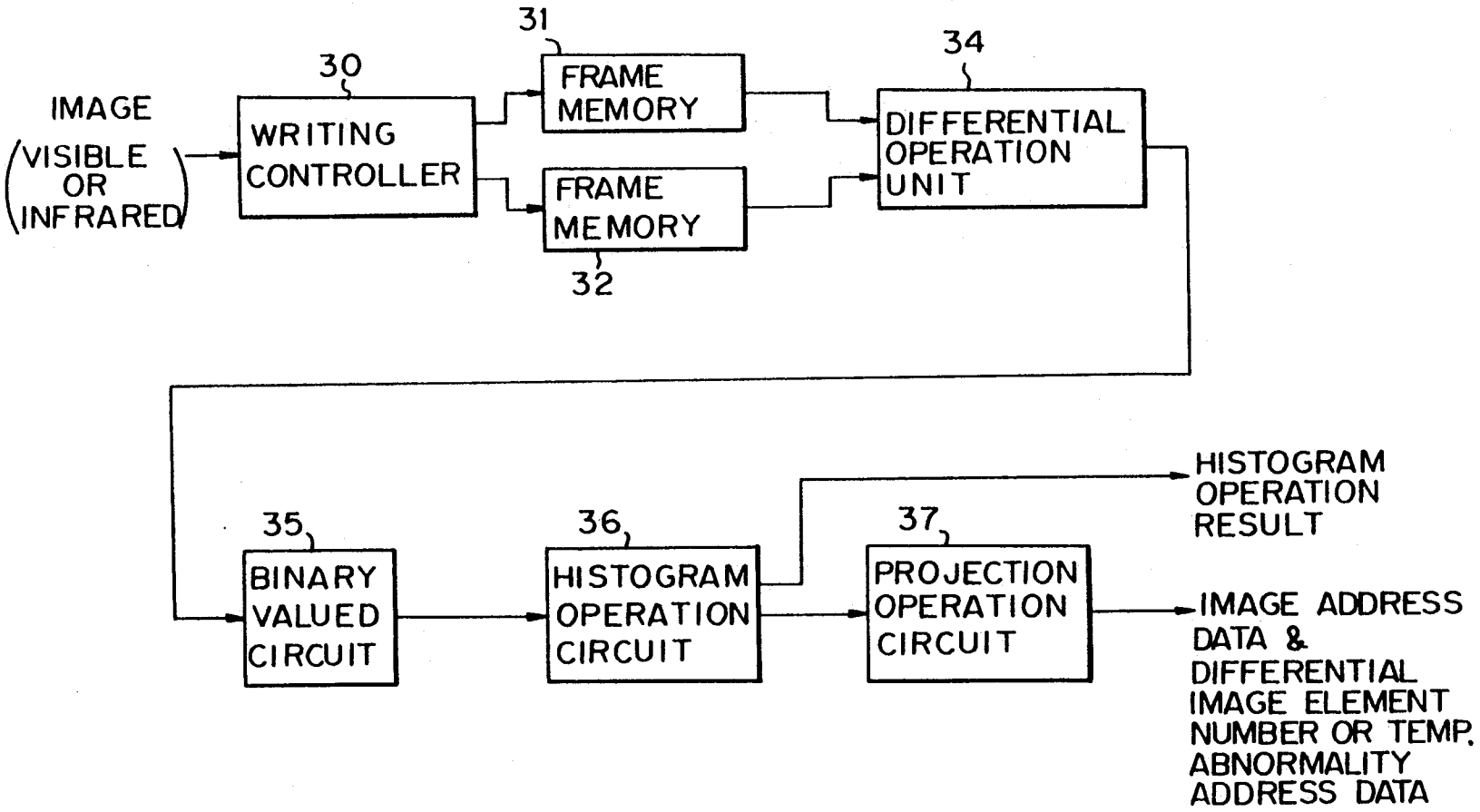
FIG. 9 is a block diagram of image processing equipment of FIG. 8.

FIG. 9 is an example of a detailed constitution of the image processing equipment 18. The image processing system actually comprises two systems the infrared image and the visible image, however, in this example, a common constitution is designated.

In the figure, 30 denotes a writing controller for controlling the storage of the picked up image from the visible/infrared ray cameras 1-1 to 1-n selected by the video switcher 17; 31 and 32 denote frame memories for storing one frame of the picked up image (reference image or input image) designated by the writing controller 30; 34 denotes a differential operation unit for operating the differential image between images read from the frame memories 31 and 32; 35 denotes a binary valued circuit for designating the image element of the differential image from the differential operator 34 by 0 or 1; 36 denotes a histogram operation circuit for executing the histogram operation to the binary valued data from the binary valued circuit 35; and 37 denotes a projection operation circuit for executing the projection operation to the histogram operation result from the histogram operation circuit 36.

OPERATION OF IMAGE PROCESSING

Figure 10A:
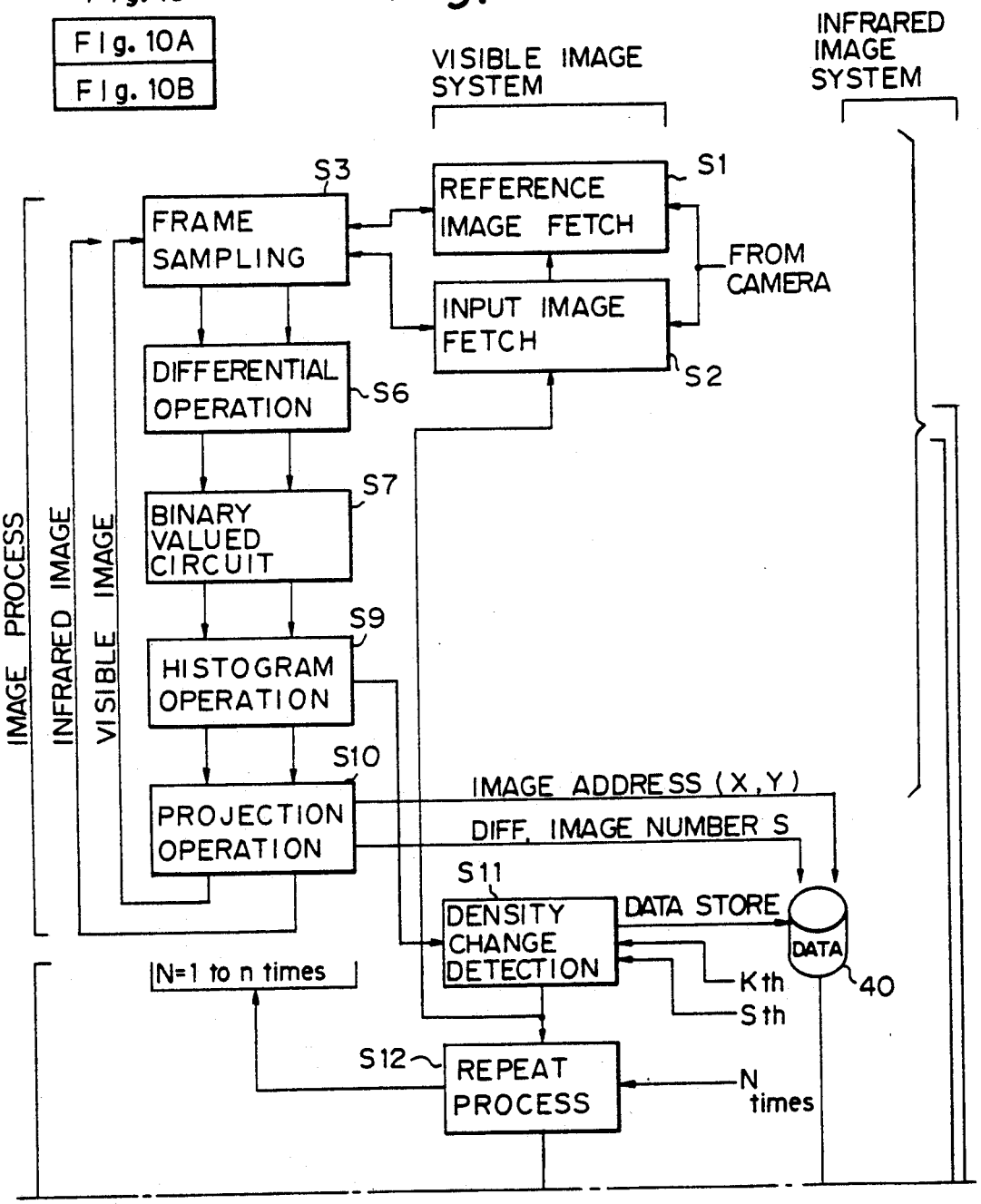
FIGS. 10A and 10B, is a process flowchart of the system of FIG. 8.
Figures 10, 10B:
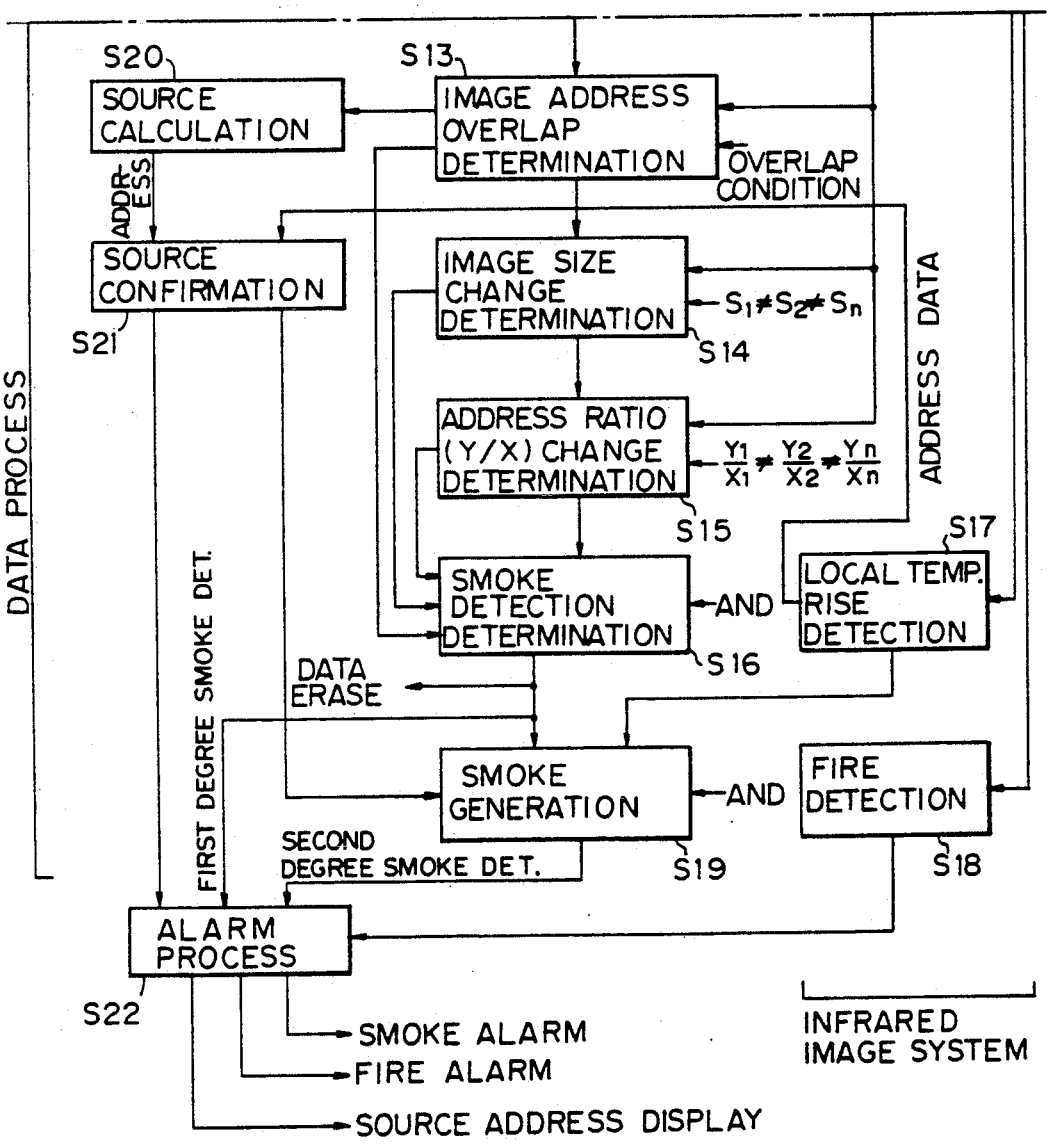
FIG. 10, comprising

First, an image processing portion in the operation of the image processing equipment 18 with reference to a flowchart designated in FIG. 10, which comprises FIGS. 10A and 10B. Although in the explanations of the image processing, the visible image and infrared image are executed separately, a common explanation is offered excepting special descriptions.

The picked up image from the visible/infrared ray camera 1 is frame sampled at a certain time interval (step S3 in FIG. 10). The preceding image is the reference image, the image after that is the input image, and they are stored in the frame memories 31 and 32 (steps S1 and S2) by the writing controller 30.

Next, the differential image between the input image and the reference image stored in the frame memories 31 and 32 by the differential operation unit 34 is calculated (step S6).

After that, binary valued processing is executed (step S7) to the calculated differential image by using the binary valued circuit 35.

Further, in the histogram operation circuit 36, the histogram, wherein, in the case of a visible image, the abscissa is divided by the density difference domain of the differential image, the ordinate designates the image element number, and the image element number corresponding to the divided density difference domain is designated, is formed (step S9).

In the case of the infrared image, the histogram, wherein the abscissa is divided by temperature domain, the ordinate designates the image element number, and the image element number corresponding to the divided temperature domain is designated, is formed (step S9).

In the projection operation circuit 37, the projecting process for projecting the image element of the differential image displayed by the histogram on the X and Y axes on the image frame is executed (step S10). In the case of the visible image, the address (X, Y) from the projection operation result and differential image element number S are calculated and stored in a file 40. In the case of an infrared image, since it is necessary that the coordinates of the abnormal temperature portion are finally specified, the center of the temperature (corresponds to a center of gravity in temperature), namely, the address information, is generated from the coordinate position by the projection operation result in accordance with the after-mentioned local temperature rise detection result in step S17.

OPERATION OF DATA PROCESS

Next, in accordance with the above-mentioned flowchart, first, the operation of the visible image system in the data processing system is explained with reference to FIGS. 5A, 5B, and 5C, FIG. 6, and FIGS. 7A and 7B. The image change detector 3, the address overlap detector 4, the image element number change detector 5, the address ratio change detector 6, and the first degree smoke detector 7 shown in FIG. 1 correspond to after-mentioned steps S11 to S12, S13, S14, S15, S16 in the flowchart, respectively. Similarly, the local temperature rise detector 10, the second degree smoke detector 11, the smoke generation source calculator 12, and the smoke source confirmation device 13 correspond to steps S17, S19, S20, and S21, respectively.

In the differential image calculated at the step S9, the change of density or size, as a parameter of the image, is detected whether it is greater than a predetermined level or not (detected condition density $>K_{th}$, size $>S_{th}$, in the step S11). If the change is less than the predetermined level $K_{th}$ and $S_{th}$, the process returns to the step S3 and repeats the fetches of the reference image and the input image, if the change is greater than $K_{th}$ and $S_{th}$, the reference image in the frame memory 31 is maintained as is, and only the input image is fetched into the frame memory 32 and updated. Thus, the calculation of the differential image between the input image and the reference image and the calculation of the address and the image element number of the differential image are repeated by N times (N=1 to n) at certain intervals (step S12).

As a result, in a file 40, N number of addresses ($X_1$, $X_2$, . . ., $X_n$), ($Y_1$, $Y_2$, . . ., $Y_n$), and N number of differential image element number ($S_1$, $S_2$, . . ., $S_n$) are stored.

Then, the N number of addresses ($X_1$, $X_2$, . . ., $X_n$) and ($Y_1$, $Y_2$, . . ., $Y_n$) stored in the file 40 are read and each of the addresses are determined whether they overlap each other on each of the X axis and Y axis as shown in FIGS. 5A, 5B, and 5C and FIG. 6 (step S13).

Also, similarly, the N number of differential image element numbers ($S_1$, $S_2$, . . ., $S_n$) are read and are determined whether they are curved as shown in FIG. 7A (determination condition: $S_1 \neq S_2 \neq \ldots \neq S_n$), (step $S_{14}$).

Further, similarly, N number of addresses ($X_1$, $X_2$, . . ., $X_n$) and ($Y_1$, $Y_2$, . . ., $Y_n$) are read and the address ratio ($Y_1/X_1$, $Y_2/X_2$, . . ., $Y_n/X_n$) on each axis are calculated, and are determined whether they are curved as shown in FIG. 7B (determination condition: $Y_1/X_1 \neq Y_2/X_2 \neq \ldots \neq Y_n/X_n$), (step S15).

From the result of the data processing, if the N number of overlapping addresses between the differential images, the size changes, and the address ratio changes are detected simultaneously from the steps S13, S14 and S15, the first degree smoke detection signal, being the initial smoke generation information, is output (step S16). In this case, when each change is not detected simultaneously, all the data stored in the file 40 are erased and the process returns to the step S1 and restarts again.

Next, the operation of the infrared image system in the data processing system in the flowchart is explained. First, the histogram calculating result in the step S9 is compared with both setting ranges of a predetermined detection temperature data and the detection image element number, only when the histogram calculating result is greater than the setting ranges, the local temperature rise is detected (step S17). Then, the conditions from the local temperature rise detection and the first degree smoke detection signal obtained from the step S16 are satisfied, the second degree smoke detection signal is output (step S19). In addition, at this time, the setting value of the temperature on the histogram, the setting value of which designates fire detection, is provided, and if an image element number greater than the setting value is more than the predetermined value, the fire is detected (step S18).

Also, by utilizing the detection result of the overlapping of the smoke generation addresses from step S13, the smoke generation source address ($X_{min}$, $Y_{min}$) in the overlap portion shown in FIG. 6 is specified and calculated (step S20). Then, the address ($X'_{l\text{-}M}$, $Y'_{l\text{-}M}$) of the abnormal temperature portion obtained from the step S17 is compared with the smoke generation source address calculated by the step S20, and if $Y'_1 < X_{min} < X'_M$, $Y'_1 < Y_{min} < Y'_M$ is satisfied, the smoke generation source address is confirmed (step S21). Then if the three conditions from the local temperature rise information obtained by step S17, the first degree smoke detection signal by step S16, and the smoke generation source address confirmation result by step S21 are satisfied, a precise second degree smoke detection signal is output (step S19). Further, in the alarm process in step S22, an alarm, indicating smoke generation, by the smoke detection signal from step S16 or S19, an alarm sent because of fire detection from step S18, or an address display of the smoke generation source (temperature abnormal portion) from step S21, can be carried out.

As explained above, in the smoke supervisory system according to the first aspect of the invention, the two visible images, which are different in image pick up time, are the input image and the reference image; the address of the image change portions or the differential image element number are calculated by fetching the input image at a plurality of times and by obtaining the differential image from the input image and the reference image; the overlapping of the address between the differential images, the change of the image element number (size), and the change of the address ratio are detected and determined; and only when all the changes are detected, smoke generation is detected. Whereby, in any environmental condition e.g. indoors or outdoors etc., this supervisory system is not affected by external change factors, a moving article or the like, and realizes early and accurate system detection of smoke generation and automatically activates the alarm, and as a result, this invention can prevent fires or explosions.

Also, the two infrared images, which have different pick up times, are the input image and the reference image, the difference image is obtained from the differential operation result, and whereby, the detection of the local abnormal temperature rise and subsequently the detection result of the above smoke generation can detect smoke generation with greater certainty.

Further, by specifying the smoke generation source address from the overlap result of the addresses and by comparing the smoke generation source address with the abnormal temperature portion address obtained by the local temperature abnormal rise result, the smoke generation source address is confirmed. Thus, a more precise smoke generation detection is possible if the conditions involving the local temperature abnormal rise detection, the smoke generation detection, and the smoke generation source address confirmation are satisfied.

Equipment Supervisory System

An equipment supervisory system according to an embodiment of a second aspect of the invention is explained.

Figures 12A, 12B, 12C:
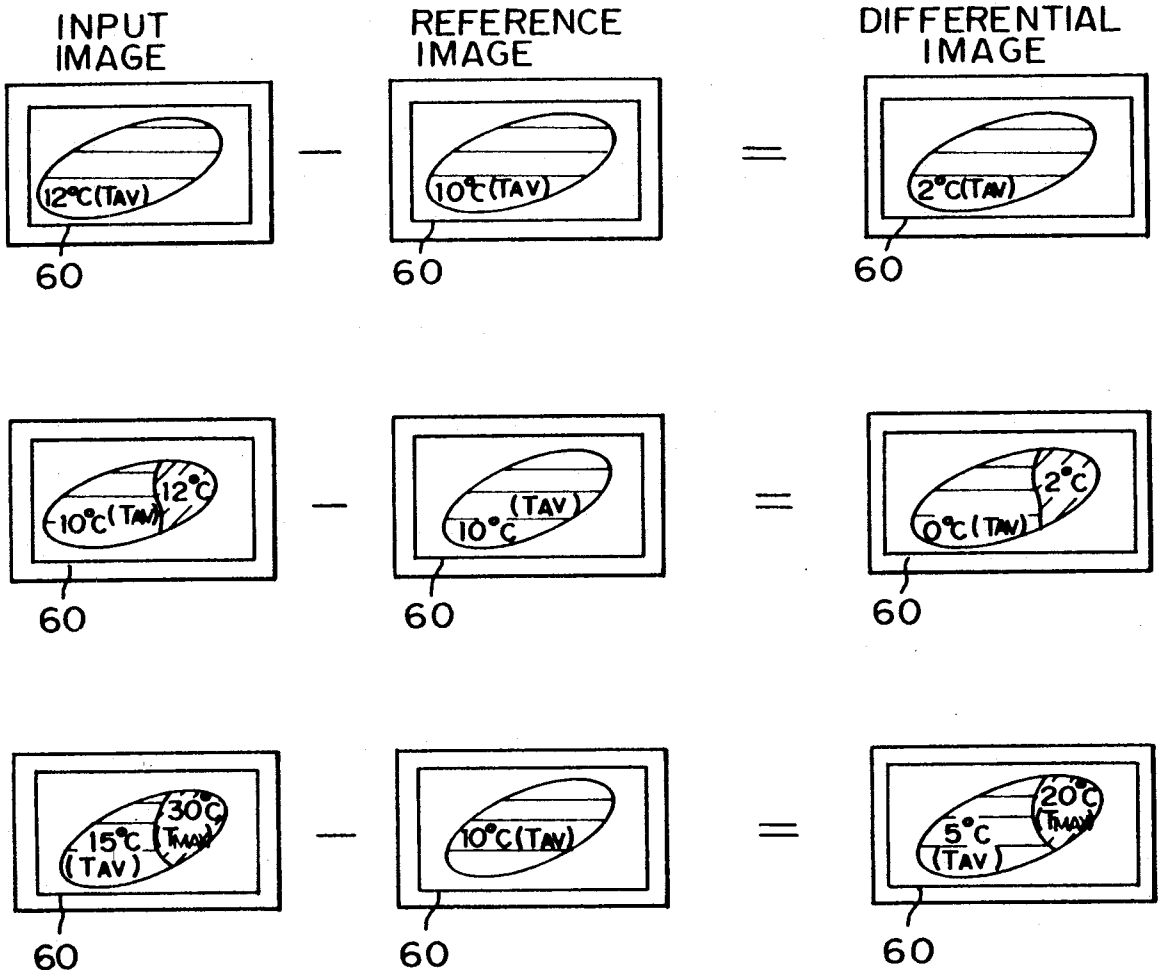
FIGS. 12A, 12B, and 12C are diagrams explaining a relationship between causes of temperature change and temperature changes.

First, related arts are explained with reference to drawings. In FIGS. 12A, 12B and 12C, a relationship between the cause of the temperature change and the temperature change is explained.

As shown in FIG. 12A, a mean temperature ($T_{AV}$: shown by horizontal lines) on equipment 60 is obtained receiving a change of the environmental temperature. If the input image is higher than a reference image, which is picked up at the usual temperature state, by 2° C., the differential image of 2° C. is obtained by a differential operation result.

Also, as shown in FIG. 12B, when the equipment experiences a temperature increase of 2° C. at a portion shown by oblique lines due to the effect of sunshine or the like; in a difference between the input image and the reference image, the mean temperature is 0° C., but the oblique line portion is 2° C.

Usually as shown in FIG. 12C, any abnormal temperature rise in the equipment is detected, and compared with a setting range of temperature data of a histogram and image element number. If the above temperature change is caused by the effect of environmental temperature change, sunshine or the like, when compared with the setting range, the change affects the same, an error occurs and the temperature abnormal sign cannot be detected precisely. The above cited method using the histogram is referred to in the aforementioned three publications.

As a result, only at night or at limited locations indoors wherein the weather conditions do not drastically change, the early temperature abnormal sign detection is carried out.

Next, a summarized explanation regarding the second aspect of the invention is explained.

Generally, in order to detect a temperature abnormality early and accurately in the equipment, as mentioned in the conventional example, an image processing system using an infrared ray camera is more advantageous than a temperature sensor system (point sensor system).

Figure 13:
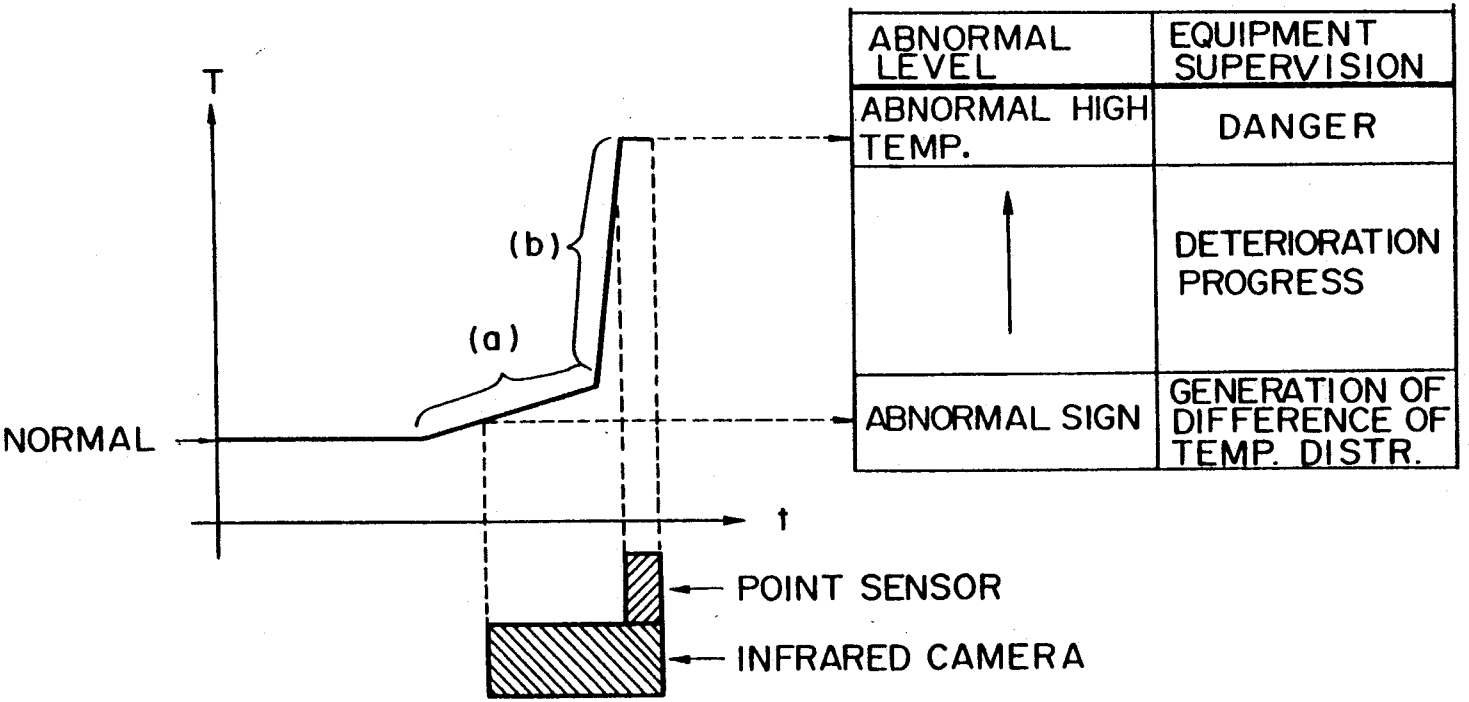
FIG. 13 illustrates a general abnormal temperature pattern in equipment to be supervised.

This is explained with reference to FIG. 13. First, when a fine temperature abnormality occurs in the equipment, the abnormal temperature spreads, stored heat increases to ignition temperature, and a fire or explosion occurs. At this time, it does not change abruptly from a normal state to dangerous abnormally high temperature, as a middle stage, there is a preliminary temperature rise, namely, an abnormal sign occurs.

The factor is an inner abnormal heat. This is realized by the change of a temperature pattern different from the normal state, as shown in the curve (a) in FIG. 13, and it proceeds slowly.

That is, while the temperature sensor system only detects the abnormal high temperature portion shown by the curve (b), if the temperature rise shown in the curve (a) is detected before the fact, a fire or explosion can be avoided.

Accordingly, in this aspect of the invention, also, the abnormal sign as a middle stage shown by the curve (a) is detected utilizing the image processing system using the infrared ray (the differential image in the temperature image).

Figure 14B:
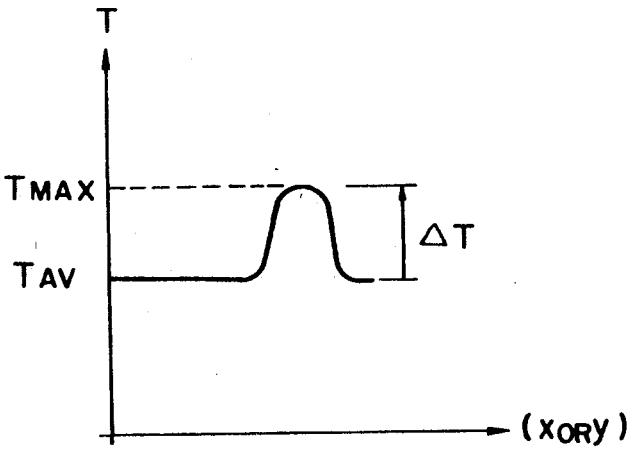
FIG. 14B is a graphical representation explaining a relationship between a coordinate and temperature in equipment to be supervised.
Figure 14A:
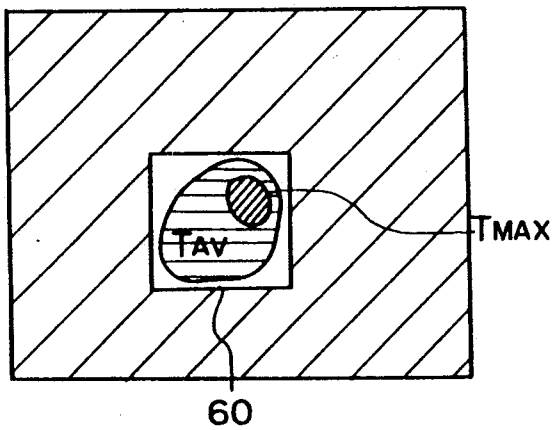
FIG. 14A is a diagram explaining a supervisory domain and an abnormal temperature.

When the above early temperature abnormal sign is detected, as shown in FIG. 14A, it is understood that a temperature distribution difference $\Delta T$ between the mean temperature $T_{AV}$ on the supervisory object 60 and the maximum temperature $T_{MAX}$, may be utilized in this problem.

That is, in this case, since the temperature distribution difference $\Delta T$ is not an absolute value but a difference between the mean temperature $T_{AV}$ and the maximum temperature $T_{MAX}$, then, it does not change by the effect of environmental temperature changes as shown in FIG. 14B (in addition, the temperature distribution difference $\Delta T$ has different values depending on the kind of equipment).

For example, as shown in FIG. 12C, from the input image occurs an abnormal sign wherein the mean temperature $T_{AV}$ is 15° C. and the maximum temperature $T_{MAX}$ is 30° C., the differential image having the mean temperature $T_{AV}$ of 5° C. and the maximum temperature $T_{MAX}$ of 20° C. by the difference from the normal reference image is obtained and the temperature distribution difference $\Delta T$ is 20° C.-5° C.=15° C. Namely, if the object is affected by the effects of the environmental temperature change, this value does not change.

Figure 11:
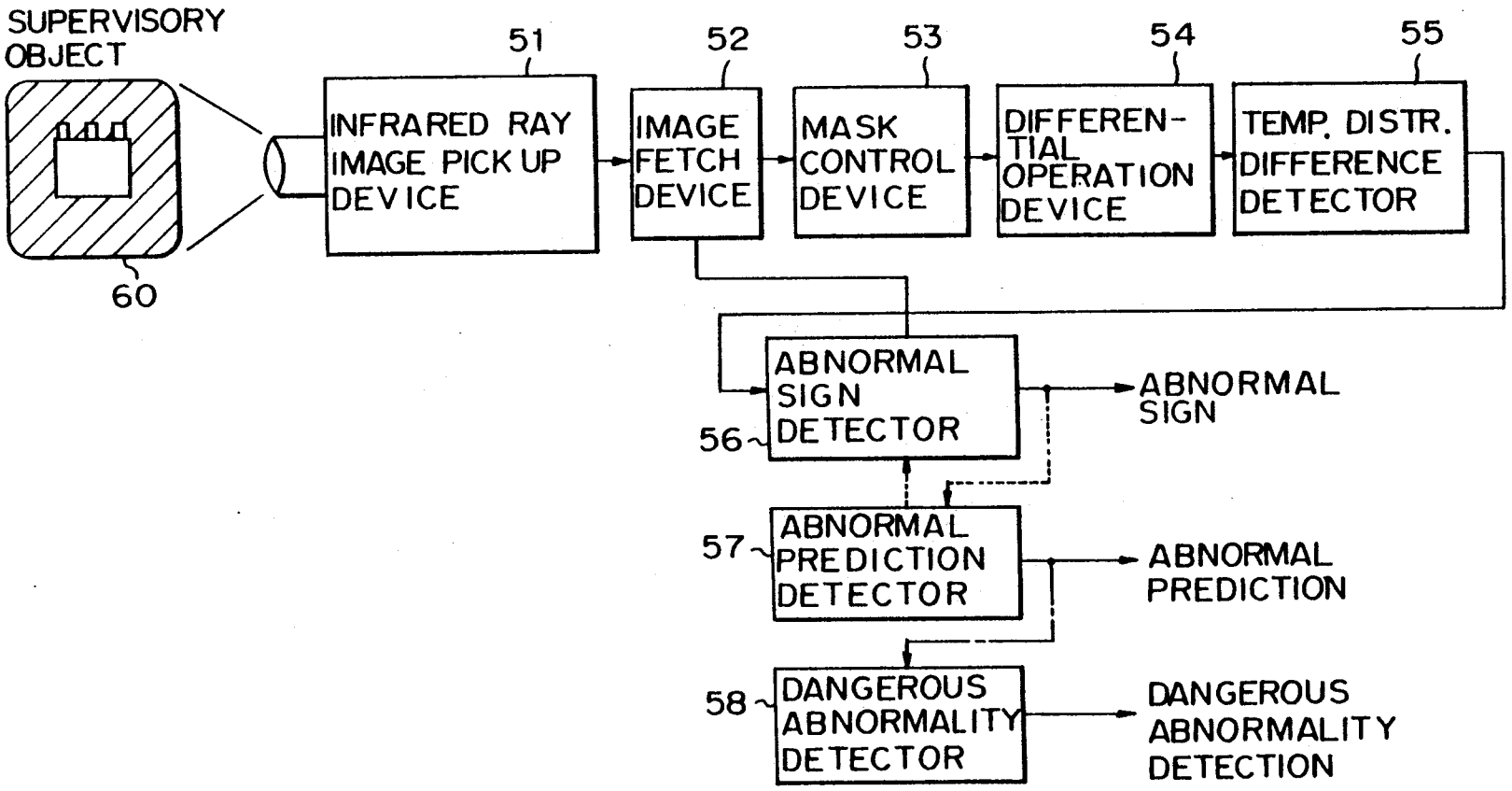
FIG. 11 is a block diagram explaining a summary of a second aspect of the invention.

Thus, in the equipment supervisory system, as shown in FIG. 11, an infrared ray image pick up device 51 constantly picks up an infrared image that has temperature data from the supervisory object 60 on equipment installed at an arbitrary location.

At this time, an image fetch device 52 fetches the picked up image from the infrared ray image pick up device 51 at a certain interval (sampling), a preceding fetched image is a reference image and the next fetched image is an input image, and these are stored.

Figures 15A, 15B, 15C:
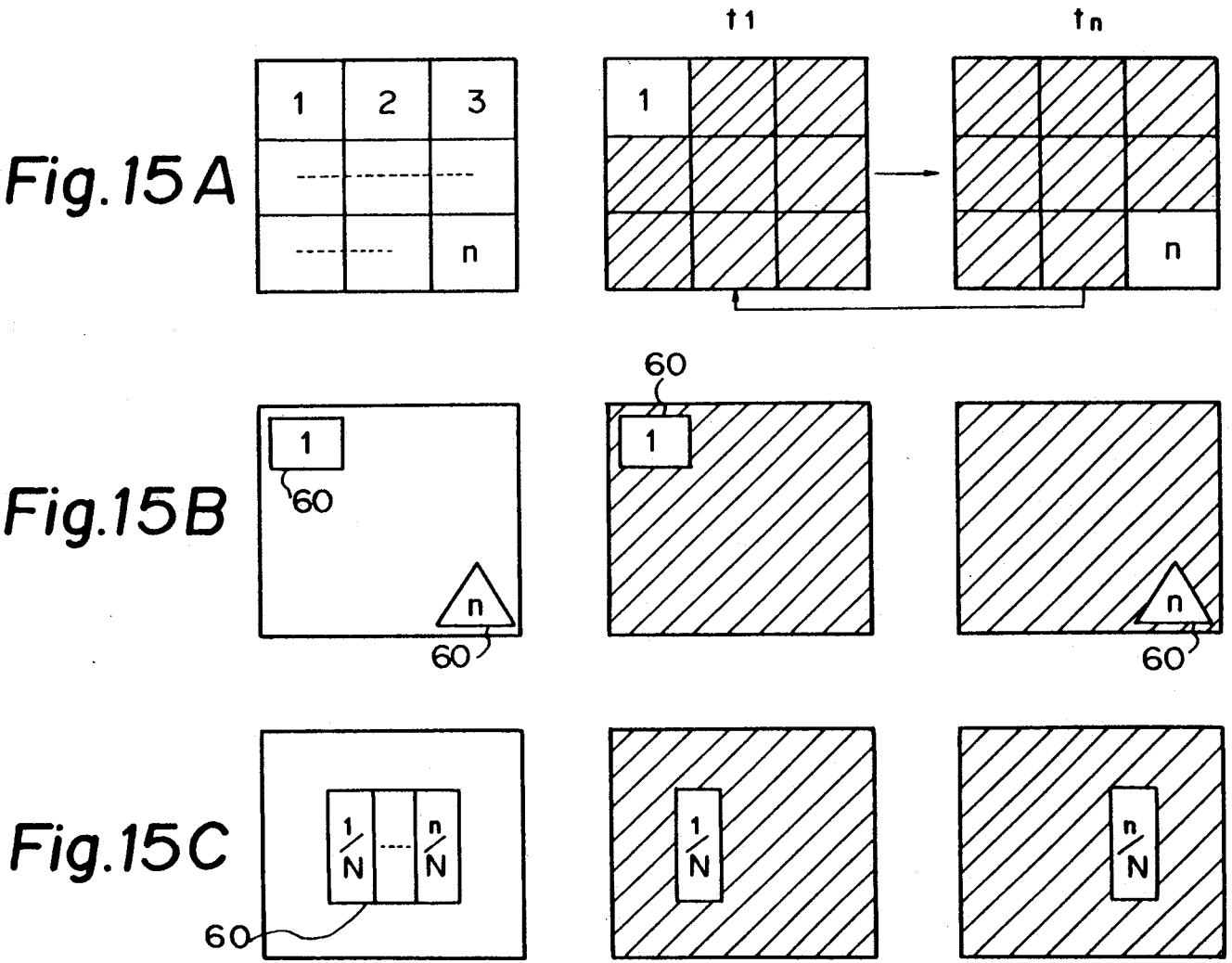

Then, a mask control device 53, as shown in FIG. 15A and FIG. 15C, is used wherein a plurality of supervisory objects 60 are supervised in one supervisory picture. Since the temperature distribution difference $\Delta T$ to be detected is usually different in each supervisory object 60, it must be processed separately, however, in the domain not necessary to supervise, the calculation of the temperature distribution difference $\Delta T$ is not necessary, thus the mask process must be processed, and the reference image and the input image are divided to be a plurality of domains (n number of domains) and the masked domains shown by oblique lines are formed.

In this case, as shown in FIG. 15C, when the calculation of one $\Delta T$ is difficult in one supervisory object 60 by the inner construction or characteristics and the effect of the weather, e.g., sunshine or wind can be avoided, a supervisory domain is further divided by 1/N to n/N.

Accordingly, in the mask control device 53, as shown in FIG. 15A, one divided image is not masked and the others are masked. The unmasked divided image is controlled to operate sequentially with the other masked divided images ((n−1) number) in each of times ($t_1$) to ($t_n$)

A differential operation device 54 calculates the differential image between the unmasked divided image of the input image and the unmasked divided image of the reference image. A temperature distribution difference detector 55 detects the mean temperature $T_{AV}$ and the maximum temperature $T_{MAX}$ on the supervisory object 60 from the differential image sequentially obtained by the mask control device 53, and the temperature distribution difference $\Delta T$ is calculated as a difference thereof.

An abnormal sign detector 56 repeats the fetch of the reference image and the imput image picked up by the infrared ray image pick up device 51 by the operation of the image fetch device 52 until the temperature distribution difference $\Delta T$ is more than a predetermined level and the number of times of processing is more than a predetermined number of times when the calculated temperature distribution difference $\Delta T$ is less than the predetermined level (preceding setting level in response to the abnormal sign detection), or the number of the temperature distribution difference $\Delta T$ calculation is less than the predetermined number.

If the calculated temperature distribution difference $\Delta T$ is more than the predetermined level and the processing number of times is more than the predetermined number, the mean value $\Delta T_{AV}$ of the temperature distribution difference $\Delta T$ of the predetermined number of processes is obtained, and further, in a certain time, this continuously repeats the calculations.

The continuously calculated mean value $\Delta T_{AV}$ of the temperature distribution difference $\Delta T$, as shown in FIG. 16, forms a curve according to the passing of time. A change in the weather or a change of load in the equipment is not continued for a long time, thus, if it is confirmed that this curve rises continuously during a certain term (time $t_0$ to $t_1$) as shown by temperature change $\alpha$, it is determined that a change in the temperature is not over a short period but is a continuous phenomenon, namely, the true temperature abnormal sign is detected.

The above curve in FIG. 16 corresponds to the curve between times ($t_0$) and ($t_1$) in FIG. 17. The above mean value $\Delta T_{AV}$ of the temperature distribution difference is included in the range between zero degree abnormal level $T_{A0}$ and first degree abnormal level $T_{A1}$.

As mentioned above, the supervisory domain is divided by a plurality of small domains, the temperature distribution differences $\Delta T$ between the mean temperatures $T_{AV}$ and the maximum temperatures $T_{MAX}$ on the supervisory object 60 are detected, respectively, the above processing is repeated statistically, thus, the temperature abnormal sign can be detected early and with certainty without the effect of weather conditions, e.g., environmental conditions, sunshine, or the like.

Further providing an abnormal prediction detector 57 shown by a broken line in FIG. 11, the calculation of the mean value $\Delta T_{AV}$ of the temperature distribution difference $\Delta T$ is repeated, the detection of the abnormal sign is repeated, thereby, the continuous rise is considered dangerously abnormal, and from the rising inclination, the prediction time $t_A$, until the dangerously abnormal level $T_{A2}$ occurs, is calculated and the abnormal prediction is possible, as shown in the range of the dangerously abnormal level $T_{A2}$ from the first degree abnormal level $T_{A1}$ during the time (t1) to (t2) shown in FIG. 17 and in the mean value $\Delta T_{AV}$ of the temperature distribution difference.

In FIG. 17, the temperature rise (prediction) curve, shown by the broken line, is different for different equipment, generally as shown by A, B, and C. The A is a simple example, in the A the scale of the abnormality is small and in the initial stage. This type of abnormality has the possibility of extension along the passing line until a certain period. In this case, the prediction time ($t_A$) is calculated approximately by the characteristic curve between ($t_0$) to ($t_1$) and the dangerously abnormal level $T_{A2}$. Similarly, the prediction time $t_A$ regarding B and C curve can be calculated.

Further, in this aspect of the invention, the dangerously abnormal detector 58 shown by a dot and dash line is provided. When the mean value $\Delta T_{AV}$ of the temperature distribution difference $\Delta T$ is higher than the dangerously abnormal level $T_{A2}$ shown in FIG. 17, the dangerously abnormal temperature is detected, and informs of a fire or explosion.

In FIG. 18, an embodiment of this equipment supervisory system is shown. 51-1 to 51-n denote n channel infrared cameras as infrared ray image pick up devices 51 shown in FIG. 11; 100-1 to 100-n denote rotary support heads for supporting and rotating the infrared cameras 51-1 to 51-n, respectively, receiving the control signal from the after-mentioned console 68; 61-1 to 61-n denote controllers for controlling image pick up states of the infrared cameras 51-1 to 51-n; 62-1 to 62-n denote transmission systems for transmitting the picked up images from the controllers 61-1 to 61-n; 63 denotes a video switcher for switching the picked up images from the transmission systems 62-1 to 62-n; 64 denotes an image processing equipment including the image fetch device 52, the mask control device 53, the differential operation device 54, and the temperature distribution difference detector 55; 65 denotes data processing equipment including the abnormal sign detector 56, the abnormal prediction detector 57, and the dangerously abnormal detector 58 for controlling the video switcher 63 and the rotary support heads 100-1 to 100-n through the transmission systems 62-1 to 62-n; 66 denotes an alarm unit for informing the alarm of the abnormal temperature sign, the dangerous abnormality, or the like in accordance with the processing result from the data processing equipment 65; 67 denotes a television monitor for displaying the differential image or the like output as a result of a differential operation by the image processing equipment 64; and 68 denotes a console connected to the data processing equipment 65 for controlling the rotary supporting heads 100-1 to 100-n. In addition, a control line from the console 68 is connected to the rotary supporting heads 100-1 to 100-n through the data processing equipment 65 and the transmission systems 62-1 to 62-n. In the figure, the same reference numeral designates the same element or the corresponding portion.

In addition, this embodiment provides n number of infrared cameras. These supervise the portions wherein only one monitor camera cannot pick up and the cameras can supervise wide domains accurately. For this reason, the cameras of CHl to CHn which are in different positions and in different pick up angles are selected using the console 68. These infrared cameras are called by reference numeral 51 as a whole.

In this embodiment, first, the infrared cameras 51-1 to 51-n pick up the temperature on the supervisory object 100 as infrared images, which are transmitted to the transmission systems 62-1 to 62-n through the exclusive controller 61-1 to 61-n, and the video switcher 63 switches and selects the picked up images from the transmission systems 62-1 to 62-n in accordance with a command from data processing equipment 65 and sends the same to the image processing equipment 64.

In the image processing equipment 64, the mean temperature $T_{AV}$ and the maximum temperature $T_{MAX}$ are calculated from the differential image between the input image and the reference image, which are different from each other in pick up time and divided into a plurality, and as a result, the temperature distribution difference $\Delta T$ is calculated.

Further, the data processing equipment 65 detects the temperature abnormal sign, the prediction of the dangerous abnormality, and the actual dangerous abnormality.

The alarm unit 66, as a result of this data processing, generates the alarm from the detection signals, and the television monitor 67 monitors the pick up images or the differential image processed by the image processing equipment 64.

FIG. 19 shows a detail constitution of the image processing equipment 64. 71 denotes a writing controller for controlling the storage of the pick up image of the supervisory object 100 switched by the video switcher 63; 72 and 73 denote frame memories for storing the pick up image designated by the writing controller 71, each by one frame; 74 denotes a mask circuit for image dividing and mask controlling to each of the pick up images read from each of the frame memories 72 and 73; 75 denotes a differential operation unit for calculating the differential image between each of the divided images sent from the mask circuit 74; 77 denotes a binary valued circuit for binary valuing each image element of the differential image from the differential operation unit 75; 79 denotes a histogram operation circuit for operating a histogram operation to the binary valued data from the binary valued circuit 77 as mentioned later; 80 denotes a projection operation circuit for projection processing to the binary valued data from the binary valued circuit 77, as mentioned later; and 81 denotes a calculation circuit for calculating the mean value $T_{AV}$ and the maximum value $T_{MAX}$ of the temperature data from the operation results of the histogram operation circuit 79 and the projection operation circuit 80.

OPERATION OF IMAGE PROCESS

An operation of an image process of the image processing equipment 64 is explained with reference to a process flowchart of FIG. 20 comprising FIGS. 20A and 20B.

The pick up image from the supervisory object 60 picked up by the infrared camera 51 is frame sampled at a certain time interval (FIG. 20A, step S53). The early sampled image is the reference image and the sampled image just after the input image. These images are stored in the frame memories 72 and 73 by the writing controller 71 (steps S51 and S52).

In step S53, the usual calculation of the temperature distribution difference $\Delta T$ is carried out by low speed sampling ($T_s$) in the time interval of being picked up by the infrared camera 51. But in order to detect a suddenly occurring abnormality at high speed, the high speed sampling $F_s$ is executed.

Next, the stored images in the frame memories 72 and 73 are divided into a plural by the mask circuit 74 as shown in FIG. 15, and the unnecessary portions are masked (steps S81 and S54). After that, the differential image between the divided input image and the divided reference image is calculated (step S56) by the differential operation unit. The mask form can be set as arbitrary form by the image processing in step S54.

After that, the calculated differential image is processed to execute a binary valued operation using the binary valued circuit 77 (step S57).

Further, in the histogram operation circuit, the abscissa is divided by a temperature domain and the ordinate designates the image element number, and by the distributed image element number in each temperature domain, the histogram is formed (step S59) from the binary valued image data.

In this case, the setting temperature designating the dangerous abnormality on the histogram is provided, and if the image element number is more than the setting value, the dangerous abnormality is determined and the detection signal of the dangerous abnormality may be sent (step S70).

In the projection operation circuit 80, the image element of the differential image displayed using a histogram is projection processed to project the same on the X and Y axis on the image frame (step S60) and is sent to the calculation circuit 81. The calculation circuit 81 calculates the maximum temperature $T_{MAX}$ in accordance with a graph display on the histogram and calculates the mean temperature $T_{AV}$ by dividing a total area of the temperature of each image element from the result of the projection operation using the projection operation circuit 30 by the total image element number (step S61), and the temperature distribution difference $\Delta T$ is calculated in accordance with the difference between the maximum temperature $T_{MAX}$ and the mean temperature $T_{AV}$.

When high speed sampling $F_s$ is executed during the detection of a fire or the like in step S53, as shown in FIG. 19 by a broken line, further an offset adder 76 giving a predetermined offset value to the differential operation unit 75, and an AND circuit 78 for executing an AND operation of the binary valued data from the binary valued circuit 77, are provided.

In this case, the offset adder 76 supplies the differential operation unit 75 with an offset value to add a predetermined offset temperature in each image element to each of the stored image data in the frame memories 72 and 73, in order to detect fire rapidly (step S55). Further, the AND circuit 78 carries out an AND operation with the binary valued image data (step S58). Finally, to specify the coordinates of the abnormal portion (fire generating portion), the center of the temperature, namely, the address information is calculated (step S69) from the coordinates by the projection operation result from the projection operation circuit 80.

OPERATION OF DATA PROCESS

Next, in accordance with the above flowchart, the operation of the data process is explained with reference to FIG. 16 and FIG. 17. The abnormal sign detector 56, the abnormal prediction detector 57, and the dangerous abnormality detector 58 shown in FIG. 11 correspond to later-mentioned steps S62 to S64, S65 to S66, and S67, respectively.

To confirm the continuous rising characteristic, the calculated temperature distribution difference $\Delta T$ is compared with the zero degree abnormal level $T_{AO}$, and if the $\Delta T$ is less than the $T_{AO}$ and if processing times N for the calculation of the temperature distribution difference $\Delta T$ is less than a predetermined $n_1$, the process routine from the fetch of the input image of the image process to the calculation of the temperature distribution difference $\Delta T$ is repeated until $\Delta T > T_{AO}$ and $N > nl$(zero degree detection of the abnormal sign: step S62).

Then, the mean value $\Delta T_{AV}$ of the calculated temperature distribution difference $\Delta T$ in the predetermined times $n_1$ is calculated. The mean value $\Delta T_{AV}(t)$, being a statistical function by time, is calculated by continuously calculating the $\Delta T_{AV}$ at data sampling intervals during a predetermined processing period (times $t_0$ to $t_1$). Then, when $\Delta T_{AV}(t) >$ the first abnormal level $T_{A1}$ (in this place $T_{A1} = T + \alpha$) and clearly the continuous rising characteristic is confirmed, the abnormal sign of the temperature is detected (abnormal sign confirmation and evaluation: steps S63 and S64) and the rising inclination data $\Delta T_{AV}(t)$ is stored in a file 90.

Then, a prediction time ($t_A$), which is the time until attaining the level $T_{A2}$, the dangerous abnormality during times from ($t_1$) to ($t_2$) regarding the mean value $\Delta T_{AV}(t)$ of the temperature distribution difference $\Delta T$, is calculated and predicts the abnormal (step S65) by confirming and predicting a rising inclination by the stored data in the file 90. In addition, in step S66, the step similar to the step S65 is repeated (trace) and recalculation of the prediction time $t_A$ is executed if necessary.

Then, when the mean value $\Delta T_{AV}(t)$ attains a dangerously abnormal level $T_{A2}$, or when the $\Delta T_{AV}(t)$ does not attain the $T_{A2}$ but the supervisory time is more than the allowable maximum time, the dangerous abnormality is detected (dangerous abnormality generation: step S67), the dangerous abnormality information is dispatched to the alarm, buzzer or the like (step S68).

In addition, in the alarm process of step S68, an alarm generation by the detection of the abnormal sign from the steps S64 and S65, an alarm generation by the dangerous abnormality detection by the step S70, a display of the prediction time $t_A$ until the dangerous abnormality from step S65 and an address display of the abnormal portion from step S69, or a graph display etc. of the mean value $\Delta T_{AV}(t)$ after generation of the abnormal sign can be executed or displayed.

As explained above, in the equipment supervisory system according to the second aspect of the invention, two infrared images different in pick up time are an input image and a reference image, each image is divided into a plurality of supervisory domains, a temperature distribution difference between a mean temperature and a maximum temperature is calculated, the processes are repeated to fetch the input image and the reference image, until an abnormal sign inclination is detected, the mean value of the temperature distribution difference is calculated, and the abnormal sign is confirmed and evaluated statistically, whereby the abnormal sign can be detected. As a result, without the effect of environmental conditions in the seasons, and weather conditions by sunshine, wind or the like, the equipment supervisory system capable of certain and early detection of the temperature abnormal sign is realized, and thus, a fire or explosion in the equipment can be avoided.

Further, if the prediction time, until the calculated mean value of the temperature distribution difference attains the dangerous abnormal level, is calculated, the abnormal procedure can be comprehended and the abnormal prediction until dangerous abnormality can be executed.

Further, if the mean value of the temperature distribution difference is detected to be more than the dangerous abnormal level, the alarm of the dangerous abnormality is activated and fire, explosion information is imparted.

I claim:

1. A smoke supervisory system comprising:

a visible ray image pick up means for picking up an image at an arbitrary location;

a visible image processing means for fetching the picked up images from the visible ray image pick up means at a certain time interval; the preceding fetching image being a reference image and the following fetching image being an input image to be supervised, for calculating a differential image from the input image and the reference image; and for calculating a two dimensional address and an image element number on an image frame of the differential image;

an image change detection means for updating the reference image and the input image in the visible image processing means when the two dimensional address and image element number of the differential image is less than a predetermined level, and for fixing the reference image and updating only the input image when the two dimensional address and image element number of the differential image is more than a predetermined level;

an address overlap detection means for detecting whether the two dimensional addresses overlap each other on the two dimensional axis;

an image element number change detection means for detecting a change in the image element number;

an address ratio change detection means for detecting the change of the address ratio by calculating the address ratio on the two dimensional axis from the two dimensional address; and a first degree smoke detection means for outputting an initial first degree smoke detection signal when each two dimensional addresses overlap by the address overlap detection means, each change of the image element number by the image element number change detection means, and each change of the address ratio by the address ratio change detection means are detected simultaneously.

2. A smoke supervisory system as set forth in claim 1 further comprising:

an infrared ray image pick up means for picking up an infrared ray at an arbitrary location;

an infrared image processing means for calculating a differential image between an input image and a reference image, which are infrared images different in pick up times in the infrared ray image pick up means;

a local temperature rise detection means for detecting a local temperature rise at a location from the differential image; and a second degree smoke detection means for outputting a second degree smoke detection signal only when the first degree smoke detection signal from the first degree smoke detection means and the local temperature rise from the local temperature rise detection means are detected simultaneously.

3. A smoke supervisory system as set forth in claim 2, wherein the local temperature rise detection means generates a temperature abnormal portion address;

the system comprises a smoke generation source calculator and a smoke source confirmation means;

the smoke generation source calculator specifies a smoke generation source address in accordance with a detection result of the address overlap from the address overlap detection means;

the smoke source confirmation means compares the smoke generation source address with the temperature abnormal portion address from the local temperature rise detection means, and outputs a coincidence signal to the second degree smoke detection means when the compared signals coincide; and only when the second degree smoke detection means is supplied simultaneously with the coincidence signal, the first degree smoke detection signal, and the temperature abnormal rise detection signal from the local temperature rise detection means, the second degree smoke detection means outputs the second degree smoke detection signal.

4. An equipment supervisory system comprising:

an infrared ray image pick up means for picking up an infrared image from a supervisory object at an arbitrary location;

an image fetch means for fetching the picked up image from the infrared ray image pick up means at a certain time interval, and for storing the preceding fetched image as a reference image and the following fetched image as an input image;

a mask control means for dividing the fetched and stored reference image and the input image into a plurality of areas, for masking all other areas except one divided image, and for sequentially moving an unmasked divided image at a certain time interval;

a differential operation means for calculating the differential image between the unmasked divided images in the divided input image and the reference image;

a temperature distribution difference detection means for detecting a maximum temperature ($T_{MAX}$) and a mean temperature ($T_{AV}$) in a temperature distribution on an object from the differential image and for calculating a difference $\Delta T$ of the temperature distribution; and an abnormal sign detection means for calculating a predetermined number of mean values ($\Delta T_{AV}$) continuously in a predetermined time to confirm a continuous temperature rise characteristic of the temperature distribution difference $\Delta T$, for detecting an abnormal sign when the calculated temperature distribution difference ($\Delta T$) is more than a predetermined level, for updating the input image to the reference image, and for repeating the fetch of the next image as an input image when the abnormal sign is not detected or before the mean value ($\Delta T_{AV}$) is calculated.

5. An equipment supervisory system as set forth in claim 4 further comprising an abnormal prediction detection means for calculating a prediction time until the mean value of the temperature distribution difference ($\Delta T_{AV}$) attains a dangerous abnormal level by repeating the detection of the abnormal sign.

6. An equipment supervisory system as set forth in claim 5 further comprising a dangerous abnormality detection means for detecting a dangerous abnormality when the mean value of the temperature distribution difference ($\Delta T_{AV}$) is more than the dangerous abnormal level.

* * * * *

UNITED STATES PATENT AND TRADEMARK OFFICE

CERTIFICATE OF CORRECTION

PATENT NO. : 5,237,308
DATED : August 17, 1993
INVENTOR(S) : Tetsuya Nakamura

It is certified that error appears in the above-indentified patent and that said Letters Patent is hereby corrected as shown below:

Column 4, line 58, delete "Smoke Supervisory System".

Column 11, line 54, delete "$Y'_1$, and insert --$X'_1$--.

Column 20, line 25, after "address;" insert --and wherein--.

Signed and Sealed this

Second Day of May, 1995

*Attest:*

*Attesting Officer*

BRUCE LEHMAN

*Commissioner of Patents and Trademarks*